US009849474B2

(12) United States Patent
Mather et al.

(10) Patent No.: US 9,849,474 B2
(45) Date of Patent: Dec. 26, 2017

(54) DENSE PHASE OR DILUTE PHASE DELIVERY THROUGH A POWDER GUN

(71) Applicant: Nordson Corporation, Westlake, OH (US)

(72) Inventors: Brian D. Mather, North Olmsted, OH (US); Terrence M. Fulkerson, Brunswick Hills, OH (US); Thomas Loparo, Sheffield Lake, OH (US); Michael F. Riley, Wyoming, MI (US); Benjamin J. Becker, Rocky River, OH (US)

(73) Assignee: Nordson Corporation, Westlake, OH (US)

( * ) Notice: Subject to any disclaimer, the term of this patent is extended or adjusted under 35 U.S.C. 154(b) by 356 days.

(21) Appl. No.: 14/413,537

(22) PCT Filed: Mar. 11, 2013

(86) PCT No.: PCT/US2013/030199
§ 371 (c)(1),
(2) Date: Jan. 8, 2015

(87) PCT Pub. No.: WO2014/014502
PCT Pub. Date: Jan. 23, 2014

(65) Prior Publication Data

US 2015/0190823 A1 Jul. 9, 2015

Related U.S. Application Data

(60) Provisional application No. 61/672,037, filed on Jul. 16, 2012.

(51) Int. Cl.
*B05B 5/00* (2006.01)
*B05B 5/03* (2006.01)
(Continued)

(52) U.S. Cl.
CPC ..... *B05B 5/032* (2013.01); *B05B 5/1683* (2013.01); *B05B 7/1413* (2013.01); *B05B 7/1472* (2013.01); *B05B 7/1486* (2013.01)

(58) Field of Classification Search
CPC ..... B05B 5/032; B05B 5/1683; B05B 7/1413; B05B 7/1472; B05B 7/1486
(Continued)

(56) References Cited

U.S. PATENT DOCUMENTS 3,767,116 A * 10/1973 Clausen ..... B05B 5/032 239/696
3,767,166 A * 10/1973 Dance ..... F16K 27/00 251/366
(Continued)

FOREIGN PATENT DOCUMENTS

CN 1575860 A 2/2005
CN 101142030 A 3/2008
(Continued)

OTHER PUBLICATIONS

China Applicaation No. 201380037862.5: First Office Action dated Jun. 22, 2016, 5 pages.
(Continued)

*Primary Examiner* — Alexander Valvis
*Assistant Examiner* — Joel Zhou
(74) *Attorney, Agent, or Firm* — Baker & Hostetler LLP

(57) ABSTRACT

A selectively configurable spray gun may include a gun body comprising a selectable forward section and a rearward section. The rearward section may be connected with either of two or more selectable forward sections so as to selectively configure the spray gun to operate either with a dense phase powder supply configuration or a with dilute phase powder supply configuration. The rearward section may include a selectable powder flow path that is connectable at
(Continued)

an inlet end to a source of dense phase powder and at an outlet end to a selectable spray nozzle in the selectable forward section that may optionally include a diffuser. An adapter may be used to connect the rearward section with a selectable spray nozzle or air cap. A manual spray gun embodiment is also presented. A selectively configurable spray gun for use with a dense phase powder supply may include a smaller diameter powder tube that extends through a larger diameter powder tube.

14 Claims, 13 Drawing Sheets

(51) Int. Cl.
*B05B 7/14* (2006.01)
*B05B 5/16* (2006.01)

(58) Field of Classification Search
USPC ..... 239/707
See application file for complete search history.

(56) References Cited

U.S. PATENT DOCUMENTS 5,850,976 A 12/1998 Robidoux
7,128,277 B2 10/2006 Schaupp
7,150,585 B2 * 12/2006 Kleineidam ..... B05B 7/1459 406/127
7,793,869 B2 9/2010 Mather et al.
7,997,878 B2 8/2011 Fulkerson
8,123,147 B2 2/2012 Fulkerson et al.
8,147,213 B2 4/2012 Hihn et al.
8,491,227 B2 7/2013 Fulkerson et al.
2003/0006321 A1 * 1/2003 Mather ..... B05B 5/032 239/690
2003/0071143 A1 * 4/2003 Mauchle ..... B05B 5/032 239/290
2003/0080220 A1 * 5/2003 Mather ..... B05B 1/04 239/690
2006/0144963 A1 7/2006 Fulkerson et al.
2008/0277507 A1 11/2008 Fulkerson et al.
2009/0057443 A1 * 3/2009 Sendo ..... B05B 3/022 239/405
2009/0107397 A1 4/2009 Mather et al.
2009/0317544 A1 * 12/2009 Dikun ..... B05B 7/1626 427/185

FOREIGN PATENT DOCUMENTS

EP 0383030 8/1990
JP 2007-502705 A 2/2007
JP 2007-106600 A 4/2007
JP 2010-525946 A 7/2010
WO 2002004127 1/2002
WO 2005018823 3/2005

OTHER PUBLICATIONS

Japan Patent Application No. 2015-523069; Reasons for Refusal; dated Dec. 22, 2016; 7 pages.
PCT International Preliminary Report on Patentability dated Jan. 20, 2015, International Application No. PCT/US2013/030199.
International Search Report dated Jun. 11, 2013 International Application No. PCT/US2013/030199.
Written Opinion dated Jun. 11, 2013 International Application No. PCT/US2013/030199.

* cited by examiner

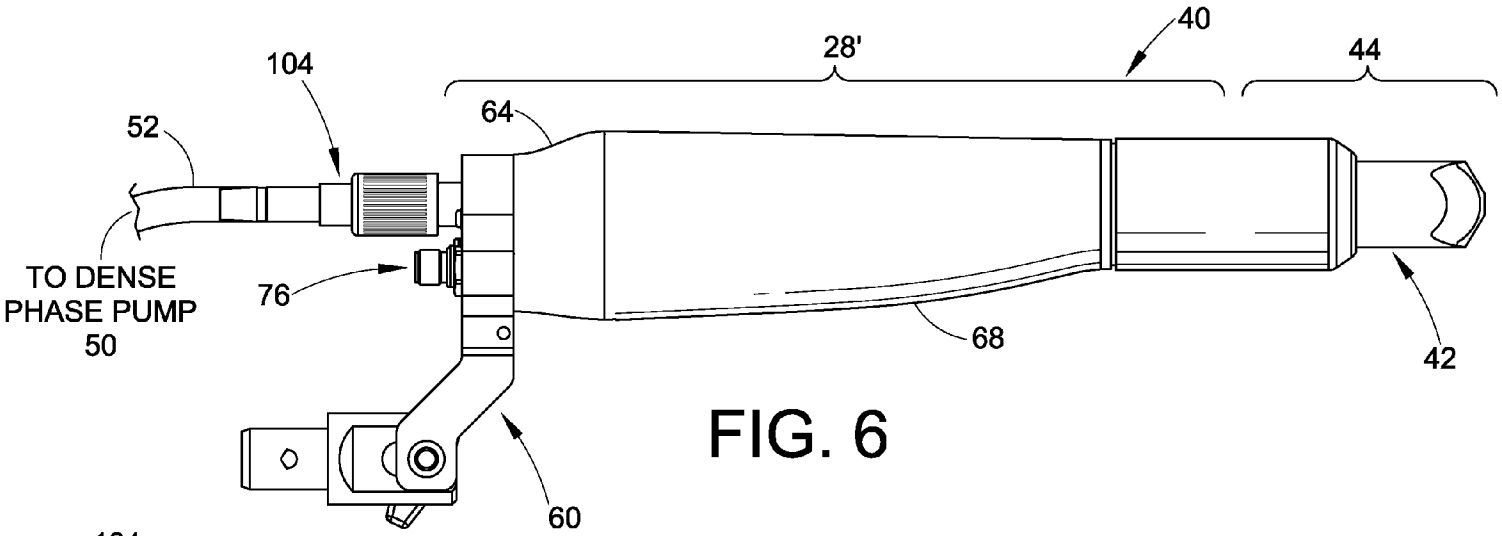
FIG. 6
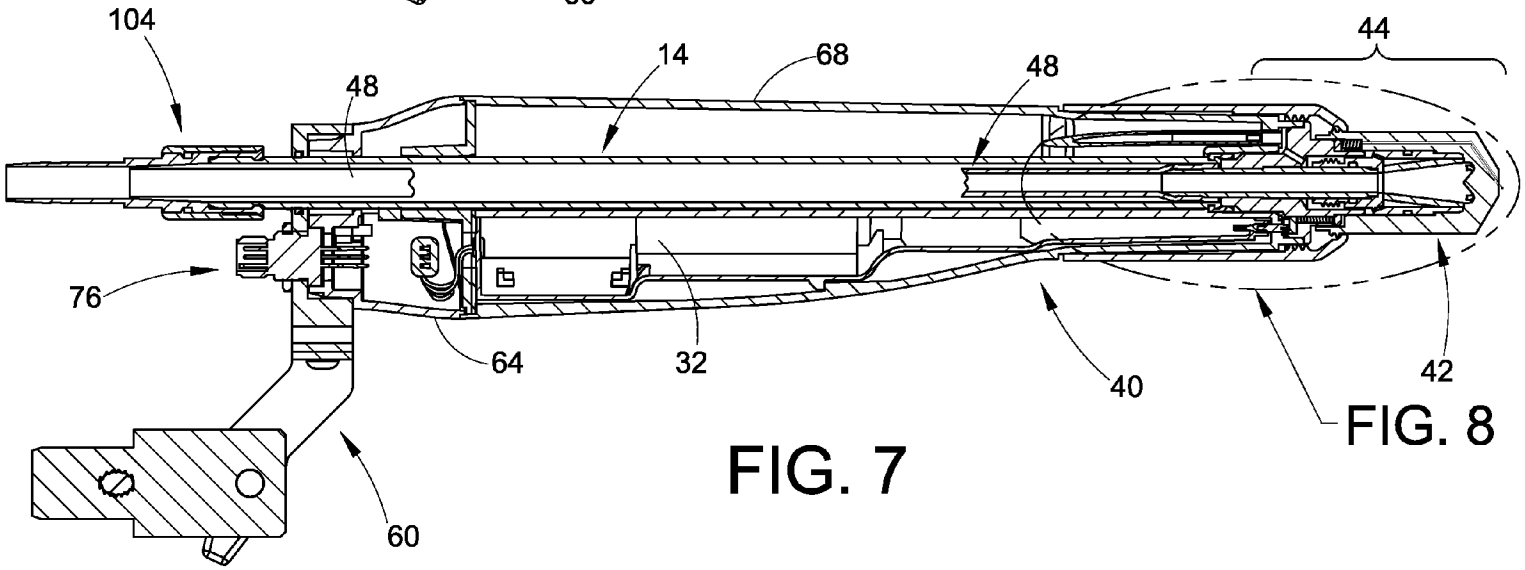
FIG. 7
FIG. 8

DENSE PHASE OR DILUTE PHASE DELIVERY THROUGH A POWDER GUN

CROSS REFERENCE TO RELATED APPLICATIONS

The present application is a national phase entry under 35 U.S.C. §371 of, and claims priority to, pending International Application No. PCT/US2013/030199 filed Mar. 11, 2013, for DENSE PHASE OR DILUTE PHASE DELIVERY THROUGH A POWDER GUN, which claims the benefit of U.S. Provisional patent application Ser. No. 61/672,037 for DENSE PHASE OR DILUTE PHASE DELIVERY THROUGH A POWDER GUN filed on Jul. 16, 2012, the entire disclosures of which are fully incorporated herein by reference.

RELATED APPLICATION

This application claims the benefit of U.S. Provisional patent application Ser. No. 61/672,037 for DENSE PHASE OR DILUTE PHASE DELIVERY THROUGH A POWDER GUN filed on Jul. 16, 2012, the entire disclosure of which is fully incorporated herein by reference.

TECHNICAL FIELD OF THE DISCLOSURE

The inventions relate generally to material application devices that are used for spraying powder coating material onto a work piece or object. More particularly, the inventions relate to material application devices, for example powder spray guns, that can be configured to receive powder coating material in dense phase and dilute phase.

BACKGROUND OF THE DISCLOSURE

A material application device is used to apply powder coating material to an object, part or other work piece or surface. A material application device is also referred to herein as a spray gun. The powder coating material can be delivered from a powder pump to a spray gun in dilute phase or dense phase. Dilute phase refers to a powder flow or stream that is a lean mixture, or in other words has a high ratio of flow air to powder. Dilute phase powder pumps are most commonly used in the form of a Venturi style pump that uses a large volume of air to draw powder from a supply and push the powder to the spray gun. Dense phase refers to a powder stream that is a rich mixture, or in other words has a low ratio of flow air to powder. Dense phase pumps are commonly used in the form of a pump chamber that uses pressure to fill and empty a pump chamber but with a low flow air volume, referred to hereinafter as flow air. Because dense phase systems use less flow air, the powder hoses can be made smaller in diameter compared with powder hoses used with dilute phase systems.

SUMMARY OF THE DISCLOSURE

In an embodiment of the disclosure, a spray gun is presented that can be selectively configured to operate with a dilute phase powder delivery or a dense phase powder delivery. For example, the spray gun can be selectively configured to receive powder coating material from a Venturi powder pump or a dense phase powder pump.

In another embodiment presented herein, a configurable spray gun may include a gun body comprising a selectable forward section and a rearward section. The rearward section may be connected with either of two selectable forward sections so as to configure the spray gun to operate either with a dense phase powder supply or a with dilute phase powder supply. In another embodiment, the rearward section may include a selectable powder flow path that is connectable at an inlet end to a source of dense phase powder and at an outlet end to a selectable spray nozzle in the selectable forward section that may optionally include a diffuser. In still a further embodiment, an adapter assembly may be used to connect the rearward section with the selectable spray nozzle having an optional diffuser.

The disclosure also presents the concept of a spray gun that can be selectively configured, converted or re-configured to operate from a dilute phase powder pump or a dense phase powder pump as the case may be, while using many common components in the selectable configurations, for example, the same rearward section. Additional embodiments are disclosed herein.

In another embodiment, an adapter assembly provides an interface or connection between one of the selectable powder flow paths and a selectable spray nozzle. For example, the adapter assembly may provide an interface or connection between a reduced diameter selectable powder tube and a selectable spray nozzle. The reduced diameter selectable powder tube may be inserted through the rearward section by sliding the reduced diameter powder tube through a larger diameter selectable powder tube that is provided with the rearward section when the spray gun is to be assembled with a different selectable configuration. For example, the reduced diameter powder tube may be of a size that is useful with dense phase powder delivery from a dense phase pump, while the larger diameter powder may be of a size that is useful with a dilute phase pump, such as a Venturi pump to name one example. In another embodiment, the adapter assembly may provide continuity for an electrode.

In another embodiment, a spray gun that can be selectively configured to operate with a Venturi pump or a dense phase powder pump includes a gun body comprising a selectable forward section and a rearward section, with the selectable forward section including a selectable spray nozzle, an optional member for adding air to the powder flow, and an optional electrode. The rearward section may be used to support a selectable powder flow path, so that the rearward section is joinable with either of two selectable forward sections so as to form either of two selectable spray gun configurations.

In another embodiment, a first selectable spray gun configuration may include a first selectable spray nozzle and a first selectable powder flow path, with the first selectable powder flow path comprising a first cross-sectional area. A second selectable spray gun configuration may include a second selectable spray nozzle and a second selectable powder flow path, with the second selectable powder flow path comprising a second cross-sectional area, with the first cross-sectional area being different from said second cross-sectional area. In another embodiment, the second cross-sectional area is smaller than the first cross-sectional area.

In another embodiment, a spray gun that can be selectively configured to operate with a Venturi pump or a dense phase powder pump includes a gun body comprising a selectable forward section and a rearward section, with the selectable forward section further including two selectable configurations, for example, a spray nozzle or an air cap. Therefore, the spray gun may have three selectable configurations, for example, a dilute phase delivery spray gun, a dense phase delivery spray with a spray nozzle and a dense phase delivery spray gun with an air cap.

Another benefit of the selectively configurable spray gun concept is that for the second spray gun configuration, it will be noted that the second selectable flow path includes a second powder tube and an adapter tube which is part of an adapter assembly. This allows the adapter tube material to be selected based on the type of powder coating material being delivered through the second powder tube and sprayed through a spray nozzle, be it organic powder or porcelain enamel powder or other powder material. The powder flow does not impact surfaces as would occur when a spider is used, so the adapter support housing 106 will not exhibit wear.

In another embodiment, a spray gun includes a gun housing having a forward section and a rearward section, the forward section comprising a spray nozzle; the spray nozzle comprising an air diffuser for adding air to powder coating material when powder coating material is flowing through the spray nozzle, and a powder flow path extending through the spray gun from the rearward section to the forward section. The powder flow path comprises a first powder tube that extends through the rearward section and that is adapted to receive powder from a dense phase pump, and the rearward section includes a second powder tube of larger cross-sectional area than the first powder tube, the first powder tube extending through said second powder tube.

In all the embodiments, the spray guns may optionally have a bar mount configuration or a tube mount configuration. The spray guns also optionally may have a manual configuration or an automatic configuration. The spray guns may also optionally provide a charging electrode that is connectable to a high voltage source for applying electrostatic charge to the powder coating material during a coating operation.

These and other aspects and advantages of the present invention will be appreciated and understood by those skilled in the art from the following detailed description of the exemplary embodiments in view of the accompanying drawings.

BRIEF DESCRIPTION OF THE DRAWINGS

FIG. 6 is an elevation view of a second spray gun in a bar mount configuration;

FIG. 7 is an elevation view of the first spray gun of FIG. 6, in longitudinal cross-section;

DETAILED DESCRIPTION OF EXEMPLARY EMBODIMENTS

Figure 1:
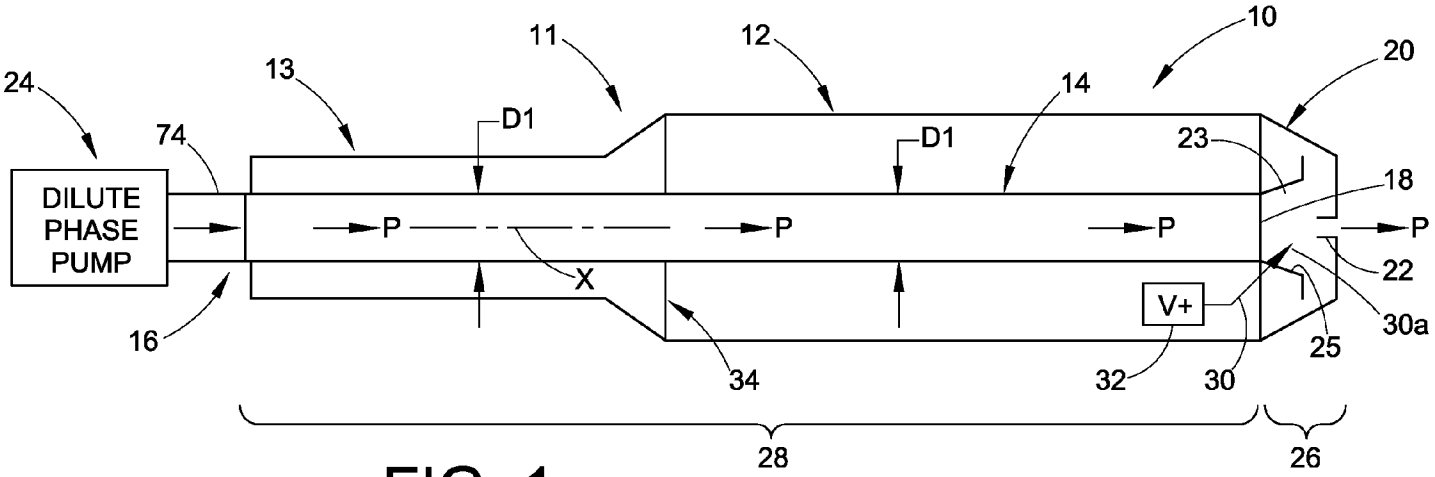
FIG. 1 (PRIOR ART)
FIG. 1 is schematic representation of a first selectable spray gun configuration or first spray gun that operates with dilute phase powder.

Although the inventions are described in terms of exemplary embodiments of spray guns with specific configurations, those skilled in the art will readily appreciate that the inventions will find application and use with many different types of spray gun designs. For example, automatic sprays guns may have mounting configurations other than bar mount or tube mount, and manual guns can have many different configurations. An automatic spray gun is one that is typically mounted on a support structure that can move the spray gun into position for a coating operation, with the spray gun actuation (for example, trigger on and off times for controlling spraying) being controlled electronically. A manual spray gun has a handle and is usually manually gripped by the operator and triggered manually to start and stop a coating operation. The exemplary embodiments also use an electrode that is connectable to a high voltage supply, for example a multiplier, so as to apply electrostatic charge to the powder coating material, but the inventions also may be used with spray guns that are not corona discharge type electrostatic spray guns. For example, the inventions may be used with tribo-charging electrostatic spray guns or non-electrostatic spray guns. Specific embodiments of various components used with the spray gun are exemplary and may be changed depending on the particular spray gun design.

A powder coating operation or coating operation for short as used herein refers to the common method of using a powder spray gun to produce a cloud of powder coating material that is directed at an object being coated. Powder coating operations may be electrostatic or non-electrostatic as is well known.

Those skilled in the art will appreciate that powder flow passages, such as provided by powder tubes, are typically cylindrical in shape, but that non-cylindrical conduits may alternatively be used. Such powder tubes have an internal cross-sectional area but not necessarily an inside diameter. For the cylinder shaped powder tubes, the diameter is an adequate reference for comparing powder tubes of different size or different cross-sectional areas. Therefore, although in the disclosure herein we generally refer to diameter of exemplary powder tubes, we do not exclude from the scope of the inventions the alternative use of non-tubular powder conduits.

Although the exemplary embodiments are described in terms of use with dilute phase delivery system, such as for example, using a Venturi pump that produces a dilute phase powder flow input to a spray gun, and a dense phase delivery system, such as for example, using a dense phase pump that produces a dense phase powder flow input to a spray gun, such terminology should not be construed as limiting the use and scope of the inventions. Precise definitions of dilute phase and dense phase are not critical to the present inventions because the inventions allow for spray guns that can operate with dilute phase powder flow, dense phase powder flow or powder flow densities across a continuum of air/ powder ratios in between dense phase and dilute phase. But for description purposes, a dilute phase powder flow is the type of powder flow that is produced by a dilute phase delivery system, for example a Venturi style powder pump, in which the powder flow has a leaner mixture of powder to air due to the high volume or amount of flow air (when compared with a dense phase powder pump) that is generated by the Venturi pump. A dense phase powder flow is the type of powder flow that is produced by a dense phase delivery system, for example a dense phase pump in which the powder flow has a richer mixture of powder to air due to the low volume or amount of flow air (when compared with a Venturi pump) that is generated by the dense phase pump. Dense phase pumps have smaller diameter powder hoses that provide dense phase powder flow to the spray gun as compared to the powder hoses that provide dilute phase powder flow from Venturi pumps due to the use of less flow air. For the basic concepts and embodiments herein, a dense phase powder flow is a powder flow produced by a dense phase pump that has a richer mixture of powder to air as compared to a dilute phase powder flow produced by a Venturi pump. The term "delivery system" is used interchangeably with the terms powder supply and powder pump.

By way of introduction, the present disclosure illustrates and describes a number of inventions and inventive concepts as embodied in the examples illustrated in the drawings and explained in the specification. One such inventive concept contemplates a first selectable spray gun configuration for powder delivered to the spray gun in dilute phase, and a second selectable spray gun configuration for powder delivered to the spray gun in dense phase.

In another embodiment, a spray gun can be selectively configured, converted or re-configured to operate from a dilute phase powder pump or a dense phase powder pump as the case may be, while using many common components in the two configurations, for example, the same rearward section. Additional embodiments are disclosed herein.

In a further embodiment of this concept, a spray gun with a first selectable configuration has a first selectable forward section that may be used to spray a lean mixture powder flow that is delivered from a dilute phase pump, for example a Venturi style pump. The dilute phase powder is input or supplied to a rearward section of the spray gun. The spray gun may then optionally be configured with a second selectable spray gun configuration in which a second selectable forward section may be used to spray a lean mixture powder flow, with the spray gun being supplied with powder coating material as a dense or rich mixture powder flow from a dense phase pump to the rearward section of the spray gun. Additional embodiments of this concept are presented herein.

The spray gun in the dense phase pump configuration or second selectable configuration provides a second selectable forward section that can be joined to the rearward section. The selectable forward section may include a second selectable spray nozzle and an adapter assembly that facilitates connecting or interfacing the second selectable spray nozzle to a forward portion or end of the rearward section. A second selectable powder flow path may be used that is connectable at an inlet end to a dense phase powder supply, and at an outlet end with the adapter assembly to be in fluid communication with the second selectable spray nozzle. Because the powder coating material in this second configuration is being supplied in dense phase, the second selectable forward section may include a member for adding air to the powder coating material when the powder coating material flows through the second selectable spray nozzle. The member for adding air may be disposed, for example, in the second selectable spray nozzle. An example of the member is a diffuser that comprises air porous material.

Another inventive concept of the present disclosure contemplates a configurable spray gun that uses many common components for two or more configurations, wherein one or more selectable configurations is for powder from a dense phase supply and the other configuration is for powder from a dilute phase supply. In an embodiment of this concept, it is to be noted that the configurable spray gun concept takes advantage of the simplicity of the selectable configurations so that the same rearward section may be used with a selectable forward section and selectable powder tube to provide either a dilute phase supply powder spray gun or a dense phase supplied powder spray gun. Additional embodiments of this concept are presented herein, including embodiments for a manual spray gun and automatic spray guns that may be selectively configured to use either a slot type spray nozzle or an air cap, all of which may use dense phase delivery to the spray gun.

In another embodiment of the configurable spray gun, in order to change over or select one of the selectable configurations with dense phase delivery, the assembler easily slides a smaller dense phase powder tube (the second selectable powder tube) through the larger dilute phase powder tube (the first selectable powder tube) that extends through the rearward section. The second selectable spray nozzle and adapter, or alternatively an air cap, are then installed on the forward end of the rearward section to complete a second selectable spray gun configuration. The second selectable spray nozzle or the air cap may alternatively be used to select the location of an electrode tip. For the second selectable spray gun configuration (spray nozzle or air cap), the electrode tip may optionally be disposed outside the second selectable spray nozzle, while for the first selectable spray gun configuration the electrode tip may optionally be disposed inside the first selectable spray nozzle.

Another inventive concept contemplates a spray gun for a dense phase powder supply that has a selectable forward section that is adapted to spray dilute phase powder. In an embodiment of this concept, a first powder tube having a first cross-sectional area extends through a second powder tube having a second cross-sectional area that is larger than the first cross-sectional area. The smaller cross-sectional area powder tube is connectable to a dense phase powder supply, and a first selectable forward section may include a spray nozzle or an air cap that dilutes the dense phase powder. When the smaller cross-sectional powder tube is removed, the larger cross-sectional powder tube is connectable to a dilute phase powder supply, and a second selectable forward section may be used that is adapted to operate with a dilute phase powder supply. Additional embodiments of this concept are disclosed herein.

In another embodiment, a spray gun for use with a dense phase powder supply is configurable using a selectable forward section that is adapted to spray dilute phase powder. In an embodiment of this concept, a first powder tube having a first cross-sectional area extends through a second powder tube having a second cross-sectional area that is larger than the first cross-sectional area. Additional embodiments of this concept are disclosed herein.

In another embodiment, the selectable forward section may have at least two selectable configurations, for example a spray nozzle or an air cap. And in a further embodiment, the selectable forward section includes structure for adding atomizing or dilution air to the dense phase powder flow delivered to the spray gun from a dense phase delivery system. In another embodiment, the selectable forward section is used with a rearward section that may be though need not be the same rearward section for all the selectable configurations of the spray gun, but using a selectable powder tube depending on whether the spray gun is configured for dense phase delivery or dilute phase delivery.

While various aspects and features and concepts of the inventions are described and illustrated herein as embodied in various combinations in the exemplary embodiments, these various aspects, features and concepts may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices and so on may be described herein, such descriptions are not intended to be a complete or exhaustive list of available alternative embodiments, whether presently known or later developed. Those skilled in the art may readily adopt one or more of the aspects, concepts or features of the various inventions into additional embodiments within the scope of the present inventions, even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present inventions however, such values and ranges are not to be construed in a limiting sense and are intended to be critical values or ranges only if so expressly stated. Additionally, even though some features and aspects and combinations thereof may be described or illustrated herein as having a specific form, fit, function, arrangement or method, such description is not intended to suggest that such descriptions or illustrated arrangements are required or necessary unless so expressly stated. Those skilled in the art will readily appreciate additional and alternative form, function, arrangement or methods that are either known or later developed as substitute or alternatives for the embodiments and inventions described herein.

With reference to FIG. 1, a first selectable spray gun configuration 10 may be realized using a first spray gun 10 which may be an automatic or alternatively manual spray gun. We will use the numeral 10 to refer generally to the first selectable spray gun configuration or first spray gun 10 for short, it being realized that the embodiment of the first spray gun 10 is but one example of many different spray gun designs that may be used. The first spray gun 10 may include a gun body 11 that includes front gun body 12 and a rear gun body 13 that house and support various components of the spray gun. The embodiments of a tube mount configuration and a bar mount configuration relate to automatic spray guns as is known in the art. Although we illustrate an automatic gun in a bar mount configuration herein, the inventions herein may also be used with a tube mount configuration and a manual spray gun configuration in a straightforward manner as described hereinbelow. The gun bodies 12, 13 may have multiple portions or pieces as needed. The housed components may include, for example, a first selectable powder flow passage, which may be realized as a first selectable powder tube 14 that defines a powder flow path P through the first spray gun 10 from a powder flow path inlet 16 to a powder flow path outlet 18. The first spray gun 10 typically also includes a first selectable spray nozzle 20 having a spray outlet 22. Powder flows from the powder flow path outlet 18, into the first spray nozzle 20 and then out the spray outlet 22.

The selectable spray gun configurations disclosed herein are noted as being a first selectable spray gun configuration and a second selectable spray gun configuration (there also is a third selectable configuration as described below). Each selectable spray gun configuration includes a selectable spray nozzle or air cap, a selectable powder flow path or selectable powder tube, and a selectable forward section. For ease of reading we oftentimes will use a shorthand reference to the "first" and "second" parts, without repeating the word "selectable" every time, it being understood that reference to first and second parts refer to the parts as used in the first and second selectable spray gun configurations respectively.

Although FIG. 1 shows a distinct line between the powder flow path outlet 18 and the first spray nozzle 20, this is for convenience only in the schematic diagrams. For example, it is common although no required that powder will flow into an expansion chamber 23 before the powder flows out the spray outlet 22. Whether the expansion chamber 23 is considered to be part of the powder flow path, the first spray nozzle (as shown in FIG. 1) or some separate flow section is not important to the present inventions. Oftentimes, the expansion chamber 23 bridges the space between the powder flow path outlet 18 and the first spray nozzle 20. For the disclosure herein of both embodiments, it is sufficient to understand that the selectable powder flow path, which may be typically realized in the form of a powder tube, has an outlet end 18 that provides powder flow into the selectable spray nozzle. The selectable powder tube is optionally fully disposed in the rearward section 28 after the spray gun is fully assembled.

An exemplary embodiment of a first selectable spray gun configuration as represented in FIG. 1 is an ENCORE® model spray gun which is available commercially from Nordson Corporation, Westlake, Ohio. However other dilute phase delivery spray guns may be used for the first selectable spray gun configuration 10. The first spray gun 10 commonly uses a first selectable powder flow path P that may have a constant inside diameter D1 of a first powder tube 14, or more precisely a powder tube with a constant transverse cross-sectional area from the inlet end 16 to the outlet end 18. This promotes better flow characteristics and allows the powder tube cross-sectional area to be designed with the first spray nozzle 20 and spray outlet 22 to obtain desired spray patterns. Having a single size powder tube also facilitates purging and color change. However, a constant cross-sectional area for the powder flow path or first powder tube 14 is not a requirement.

A spray gun may be designed to function as a dilute phase delivery spray gun using dilute phase powder flow from a dilute phase pump, for example, a Venturi pump. Alternatively, a spray gun may be separately and distinctly designed as a dense phase delivery spray gun that receives a dense phase powder flow from a dense phase pump. There are significant differences between the two spray gun designs due to the characteristics of the powder flow received from the delivery system, and therefore the spray gun designs, and especially the spray nozzles and the powder tubes and hoses, are different for dense phase and dilute phase delivery, spraying and coating operations. This has resulted in the need for having spray gun parts inventory for both style spray guns. In the exemplary embodiment of FIG. 1, because the ENCORE® model spray gun uses dilute phase powder supplied from a dilute phase pump 24, the first powder tube 14 may be, although need not be, a tube, for example a single piece tube, having a constant diameter D1 or cross-sectional area from the powder flow path inlet 16 to the powder flow path outlet 18. Because the first spray gun 10 is used for spraying dilute phase powder flow, a frusto-conical portion 25 of the flow path may be provided at or very near or within the first spray nozzle 20. This frusto-conical portion 25 serves as the expansion chamber 23 which allows the dilute phase powder flow to decelerate and further diffuse to facilitate spray pattern shaping from the first spray nozzle 20. The dilute phase spray gun does not add air into the dilute phase powder flow because a dilute phase pump like a Venturi pump produces a high ratio and high velocity flow air in the powder flow.

The first spray gun 10 can be thought of as having a first selectable forward section 26 and a rearward section 28. The first selectable forward section 26 includes the first spray nozzle 20, and may also include an optional charging electrode 30 that receives electrical energy from a high voltage multiplier 32 that is electrically connected with the electrode 30. In typical spray guns, the multiplier 32 may be located in the rearward section 28. In FIG. 1 the location of the multiplier 32 is shown schematically. In a conventional dilute phase spray gun such as the first spray gun 10, the electrode tip 30*a* may be disposed within the first spray nozzle 20 interior volume.

We present herein the concept of a configurable spray gun that can have two or more selectable spray gun configurations. More configurations may be used as desired, but for purposes of this disclosure we present three exemplary selectable spray gun configurations. An important benefit of the configurable spray gun is to realize significant savings and use of common parts which can reduce having different parts inventories for different spray guns. Not only can there be selectable configurations when putting a spray gun together, but the spray guns can be easily and conveniently configured, re-configured or converted between the selectable configurations. In the exemplary embodiments, we start with a known design for a dilute phase spray gun 10 that operates with a dilute phase powder flow that is input to the rearward section from a dilute phase pump as a first selectable spray gun configuration. We further provide the ability to easily and conveniently convert or configure the dilute phase spray gun 10 into a second selectable spray gun configuration 40, or second spray gun 40 for short (FIG. 2), that can receive a dense phase powder input flow from a dense phase pump. In accordance with our inventions, the configuration or conversion is accomplished by providing a second selectable forward section that may include a second selectable spray nozzle (or an air cap as another selectable configuration) with an optional electrode, and an adapter assembly. Both spray guns 10, 40 may utilize the same rearward section 28' as will be apparent from the descriptions below, but the second spray gun 40 may include a second selectable powder tube in the rearward section that is connectable to a dense phase pump.

It is important to note that although the exemplary embodiments herein illustrate a prior art spray gun 10 as one of the selectable spray gun configurations, such is for convenience and is not required. The configurable spray gun concept of the present disclosure may be realized by providing a first selectable spray gun configuration that is operable with a dilute phase powder flow input, even if it is a wholly new design, and also providing a second selectable spray gun configuration with structure to convert or alternatively configure or re-configure the first spray gun configuration to operate with a dense phase powder flow input, in accordance with the teachings herein. Also, the reference as to which selectable configuration is "first" or "second" or "third" is arbitrary and is used simply as a convenient reference to distinguish the selectable spray gun configurations.

Figure 2:
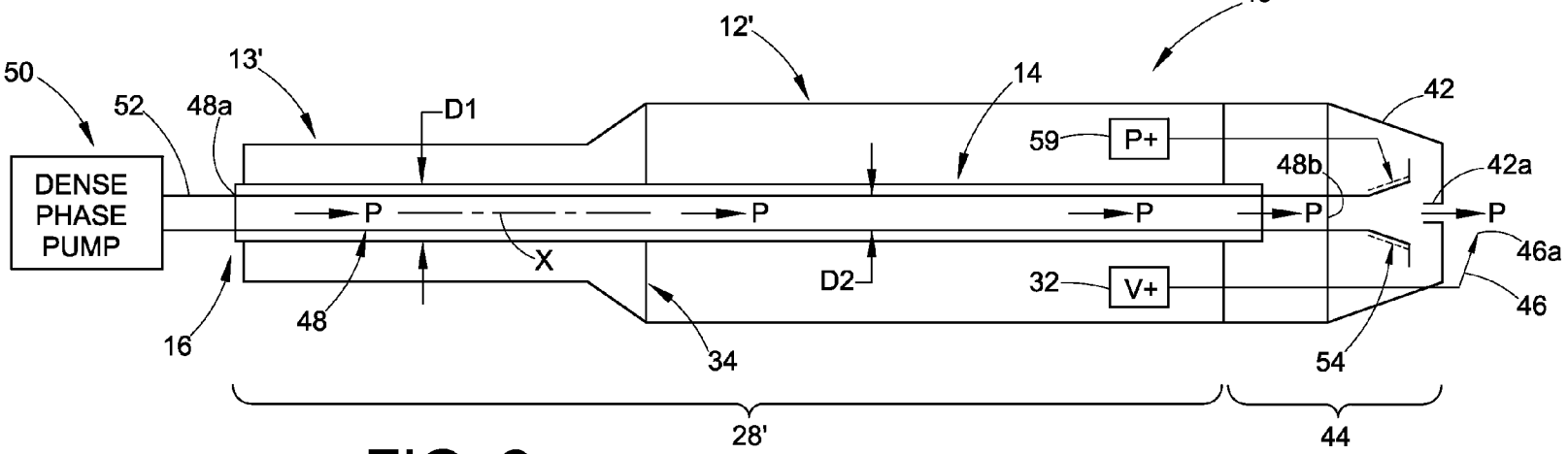
FIG. 2 is a schematic representation of a second selectable spray gun configuration or second spray gun in accordance with the teachings and inventions in this disclosure.

In accordance with this inventive concept of the present disclosure, and in reference to FIG. 2, we illustrate an embodiment of a second selectable spray gun configuration 40 or second spray gun 40 for short, that may share many of the same components as the first spray gun 10 of FIG. 1, but with several different features. Parts that may be but need not be the same, are given the same reference numerals as the embodiment of FIG. 1 but with a prime (') marker. Accordingly, the second spray gun 40 may include a rearward section 28' that may be the same as or have many of the same components as the rearward section 28 in the first spray gun 10. For example, the rearward section 28' may include the first powder tube 14' and the multiplier 32'.

It is a significant feature and benefit of the present inventions, although not necessarily required, that the selectable spray gun configurations 10, 40 of FIGS. 1 and 2 can share the same rearward section 28, 28' configuration, with the configuration of FIG. 2 only using a few quick and convenient modifications to convert between the two configurations. In particular, the rearward section 28' may include a second selectable powder tube (48) that has a smaller diameter than the powder tube 14 of the first spray gun 10. The second spray gun 40 may further include a second selectable spray nozzle 42 (or alternatively an air cap) that is provided as part of a second selectable forward section 44 that can be joined with the rearward section 28'.

The second selectable forward section 44 of the second spray gun 40 may include the second selectable spray nozzle 42 having a spray orifice 42*a* and an electrode 46. Because the powder flow must dilute over a shorter distance as compared with the first spray gun 10, it may be desirable to dispose the electrode tip 46*a* outside the spray nozzle 42. In the first spray gun 10 of FIG. 1, the electrode tip 30*a* may be disposed inside the first spray nozzle 20, for example, using a spider as is known in the art. The electrode 46 in the second spray gun 40 may be supported by the second spray nozzle 42 as needed.

Powder coating material P will be supplied to the second selectable forward section 44, including the second selectable spray nozzle 42, through a second selectable powder tube 48. The second powder tube 48 includes an inlet end 48*a* connectable to a dense phase pump 50, for example, using a dense phase powder supply hose 52. The powder flow at the outlet end 48*b* of the second powder tube 48 will be dense phase. In order to spray the dense phase powder, air may be added to the powder flow. The second spray nozzle 42 may include a diffuser 54. The diffuser 54 may be, for example, a frusto-conical body that is made of a material that is porous to air. The diffuser 54 therefore acts as both an expansion chamber and a member for adding air to the powder flow. The diffuser 54 may be disposed within the second spray nozzle 42. Alternative structure as needed may be used for adding air into the dense phase powder other than a diffuser 54.

The second powder tube 48 for the second spray gun 40 may have a smaller diameter D2 as compared to the first powder tube 14 of the first selectable spray gun configuration. As part of the configuration of the second spray gun 40, the second powder tube 48 may be inserted into the second spray gun 40 through the back end of the rearward section 28'. The second powder tube 48 can be pushed forward through the inside space of the larger diameter first powder tube 14 in a telescoping manner as illustrated in FIG. 2.

It should be noted that when we refer herein to a dense phase pump, we refer to a pump that produces a powder flow that has a higher ratio of powder to flow air as compared with a dilute phase pump, for example a common Venturi style powder pump. As it pertains to the present disclosure, a dense phase powder flow will use a powder hose from an outlet of a dense phase pump to an inlet end of the spray gun, as well as a powder flow passage within the spray gun, that have a smaller diameter or cross-sectional area than the powder hose and the powder flow passage in the spray gun used with a Venturi or other dilute phase pump.

Figure 3:
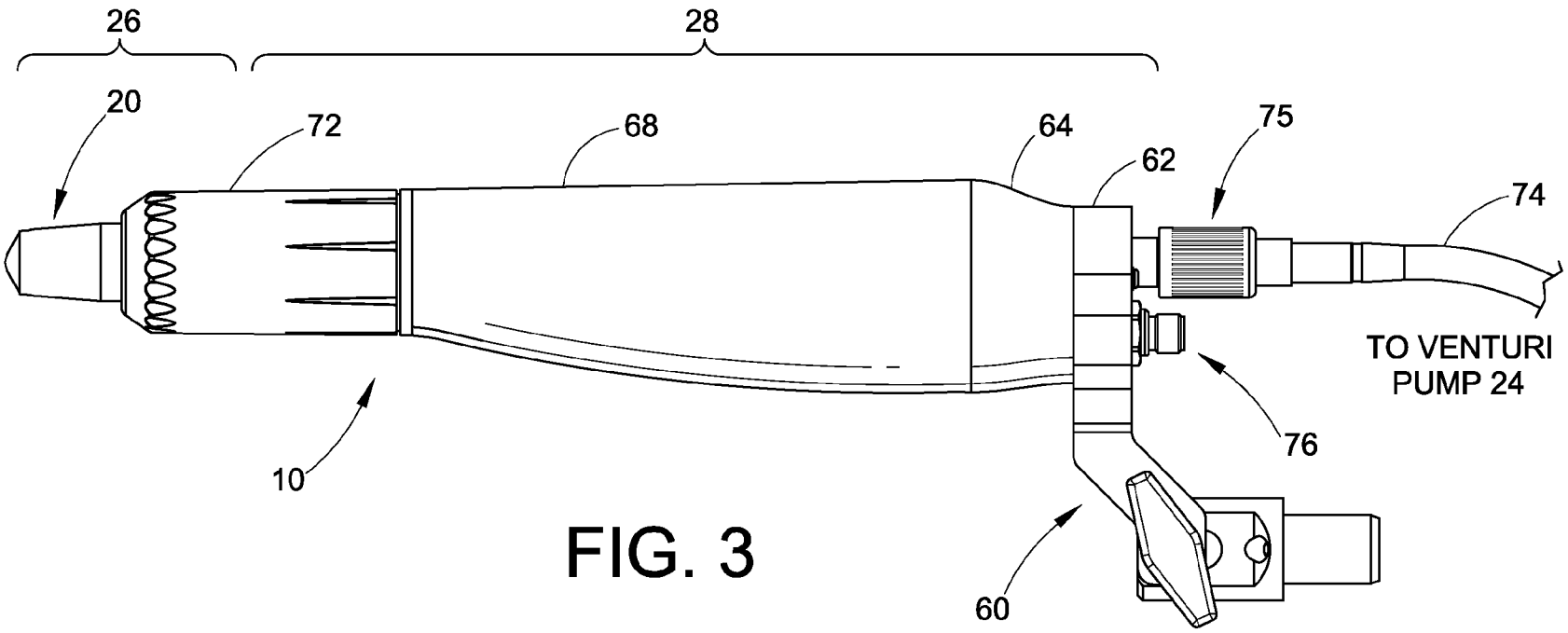
FIG. 3 is an elevation view of a first spray gun in a bar mount configuration.
Figure 4:
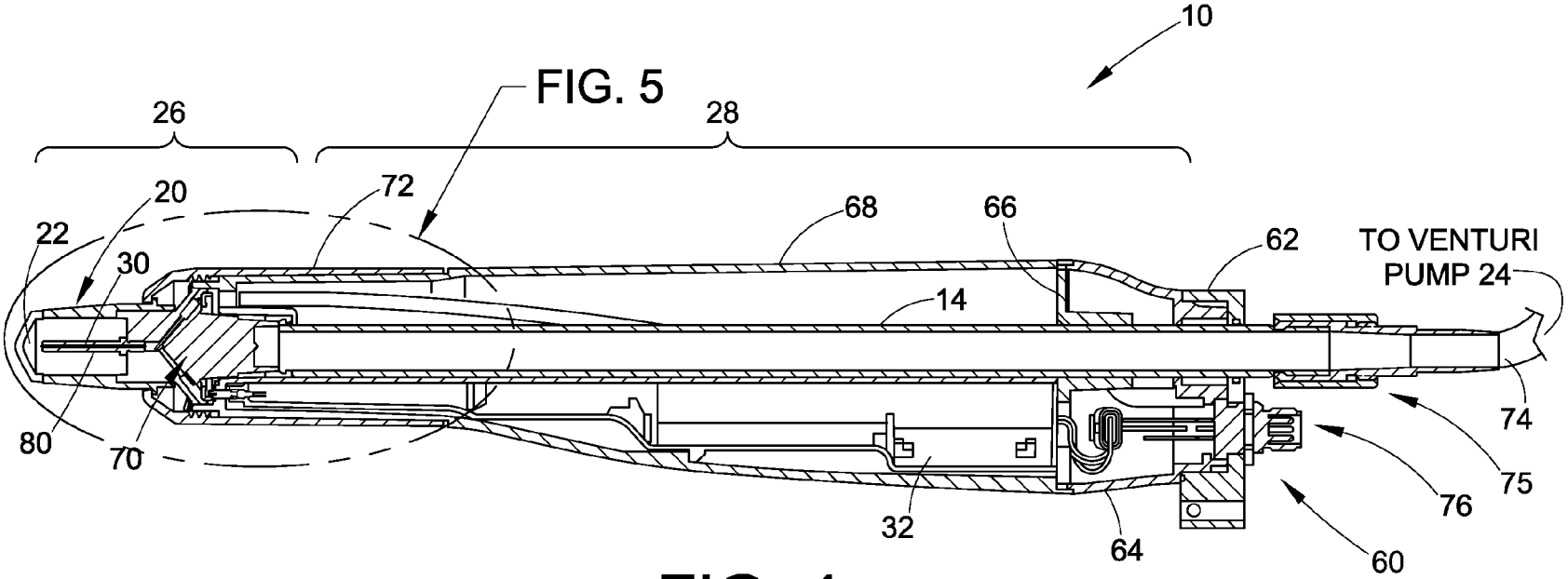
FIG. 4 is an elevation view of the first spray gun of FIG. 3, in longitudinal cross-section.
Figure 5:
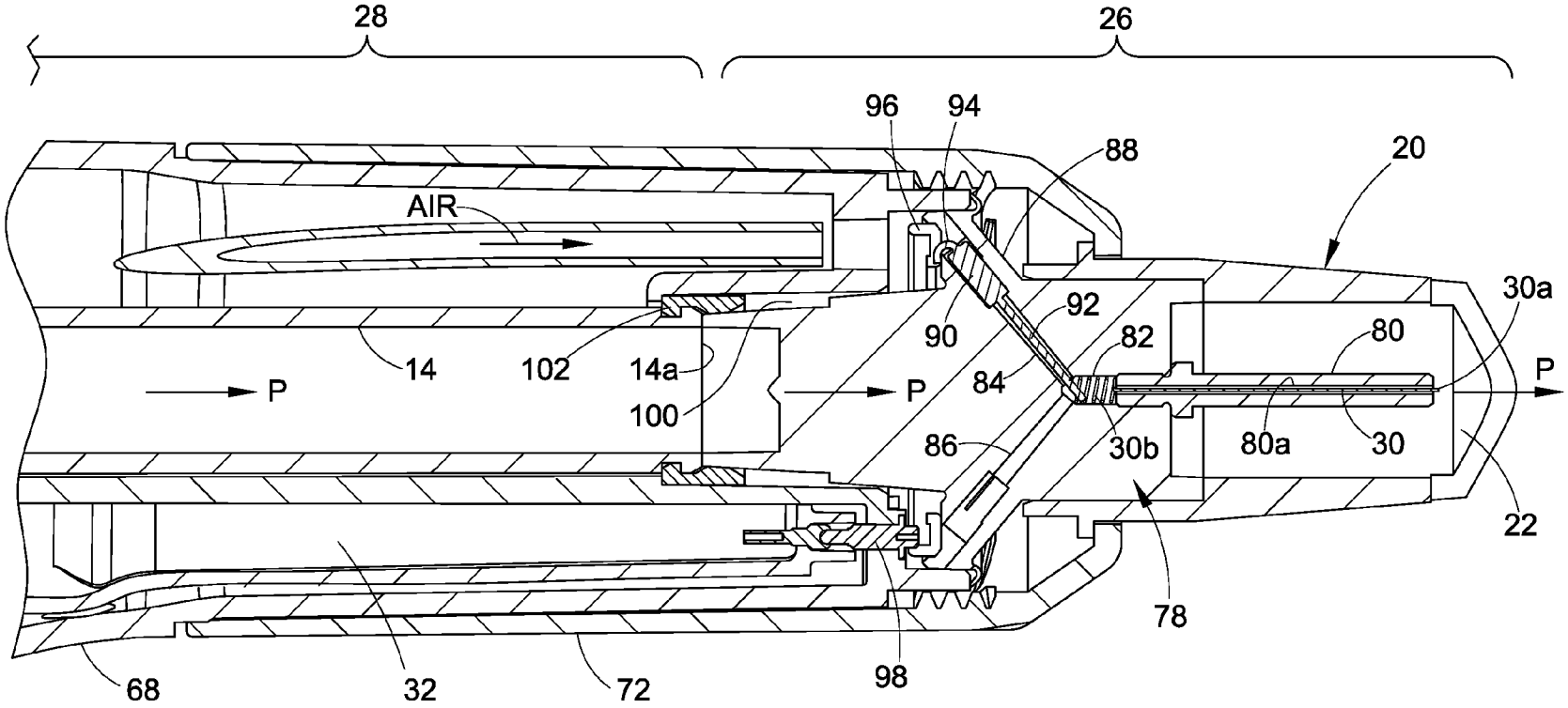
FIG. 5 is an enlarged view of the circled portion of FIG. 4.

With reference to FIGS. 3, 4 and 5, we illustrate an embodiment of the first spray gun 10 in a bar mount configuration. A tube mount configuration and a manual spray gun configuration will be basically the same as far as the forward section of the spray gun is concerned. The rest of these types spray gun may be conventional. This is another significant benefit of the present inventions in that the configurable gun concepts may be utilized with bar mount, tube mount and manual gun designs because it is primarily the front end of these spray guns that gets configured. The back end of the spray guns are modified only as to which selectable powder tube is to be used and how to connect the powder tube to the associated pump via the feed hose.

The first spray gun 10 may be but need not be realized in the form of the ENCORE® model spray gun which is commercially available from Nordson Corporation, Westlake, Ohio, and is well known to those in the art. Therefore, a detailed description of that spray gun is not required to understand and practice the inventions of the present disclosure. We provide the description of the spray gun 10 as it pertains to the parts that are associated with the selectable configurations.

The first spray gun 10 may include the first selectable forward section 26 and the rearward section 28 which includes a bar mount assembly 60. The bar mount assembly includes a mount bracket 62. A rear gun body 64 (which may correspond to the rear gun body 13 in FIG. 1) may be connected to a bulkhead 66 that is also connected to a front gun body 68 (which may correspond to the front gun body 12 in FIG. 1). The first powder tube 14 may be a single piece powder tube that extends through the spray gun 10 and has a front end 14*a* (FIG. 5) that is received in a spider 70. Because the first spray gun 10 is designed for dilute phase powder spray, the first powder tube 14 may be of a larger diameter as is known. The first spray nozzle 20 is attached to a forward end of the front gun body 68 using a threaded nozzle nut 72. The spider 70 supports the electrode 30. The first powder tube 14 extends out the back end of the first spray gun 10 and can be connected to a dilute phase powder supply hose 74 with an appropriate hose connector 75 assembly. The powder supply hose 74 is connectable to an output of the dilute phase pump 24 (FIG. 1) such as a Venturi pump, for example. An electrical connector 76 is connectable to an electrical energy source (not shown) for supplying power to the multiplier 32. The multiplier 32 is electrically connected to the electrode 30 as described herein below.

With reference to FIG. 5, the first selectable forward section 26 may be the same for the tube mount configuration or a bar mount configuration, or a manual spray gun configuration as needed. The first forward section 26 includes an electrode support assembly 78. The electrode support assembly 78 may include an electrode holder 80 that has the electrode 30 disposed within a passage 80*a* in the electrode holder 80. The electrode tip 30*a* extends outside the electrode holder 80. The electrode holder 80 has a first end that is received in the spider 70. The electrode 30 includes a coiled end 30*b* that extends into a blind bore 82 in the spider 70. Two angled ducts 84, 86 are provided in the spider 70 and extend outward through a flange 88. In one of the angled ducts 84, a current limiting resistor 90 is disposed and has a first lead 92 that extends down to contact the electrode coiled end 30*b*. A second lead 94 of the resistor 90 contacts a conductive ring 96 that is supported on a back side of the flange 88. The multiplier 32 is connected to an output contact pin 98 that contacts the conductive ring 96. In this manner, high voltage electrical energy from the multiplier 32 is electrically connected to the electrode 30. The spider 70 includes flow passages (not shown) that allow powder to flow past the spider 70 and into the spray nozzle 20. Note that an air tube (132 described below) receives pressurized air from an air source (not shown). The pressurized air flows from the air tube (132) through an air fitting (134, FIG. 8) into the spider ducts 84, 86 to serve as electrode wash air.

We note here that although the exemplary embodiments disclose various designs for the spray nozzles and air caps used for spraying the powder coating material, whether received as dense phase or dilute phase powder flow, these are but a few examples of many known or later developed spray nozzle and air cap designs that may be used to carry out the present inventions.

At this point, some of the differences between a dilute phase spray nozzle and a dense phase spray nozzle are useful to understand. In a spray gun for powder that is supplied with dilute phase delivery, for example from a Venturi or other dilute phase powder pump, for example the ENCORE® model spray guns discussed herein, the spray nozzle may be designed to provide a desired spray pattern through a slot or other spray outlet 22 in the spray nozzle 20. The powder flow into the spray nozzle tends to have a high velocity and a large volume of flow air, thus providing a lower powder/flow air ratio or in other words a lean mix. The spray nozzle typically then does not have atomizing air or dilution air added because the powder flow is already dilute. The spray nozzle will tend to dissipate some of the energy of the powder flow as it exits the powder tube, and then form a desired spray pattern, often like a cloud of powder coating material. Typically the electrode tip will be disposed within the spray nozzle.

For a dense phase spray gun used with a dense phase delivery, the powder tube can serve as the spray outlet because the dense phase powder flow may appear as a liquid-like or stream-like flow. In this case, and air cap may be used to apply pressurized air to atomize or dilute the powder flow and to shape the spray pattern just forward of the powder tube outlet end, with the electrode tip typically being disposed exterior the front end of the spray gun. In other cases, a dense phase spray nozzle may include a source of atomizing or dilution air in the nozzle for diluting the spray powder flow before it exits the spray nozzle and is exposed to the electrode.

Again referencing FIG. 5, the spider 70 may include a tapered channel 100 (which may correspond to the frusto-conical path portion 25 in FIG. 1) adjacent the front end 14*a* of the first powder tube 14. This tapered channel 100 may be frusto-conical in shape and is used in a dilute phase spray gun to allow the high flow powder stream to dissipate some energy as it enters the first spray nozzle 20 and also to further diffuse so that the powder can be electrostatically charged more efficiently.

The first powder tube 14 may be positioned and held adjacent to the spider 70 by a retaining seal member 102. The spider 70 is captured between the spray nozzle 20 and a front end of the front gun body 68 when the spray nozzle nut 72 is tightened onto the front gun body 68. This also applies an axial load against the first powder tube 14 to help seat the spider 70 in the retaining seal 102.

It should be noted at this time that the exemplary embodiments herein illustrate components that are of a selected shape and size as needed for particular spray gun designs. However, in terms of providing a spray gun design that can selectively be configured to operate with a dilute phase or dense phase spray gun, the choice of which parts may be the same and which parts are swapped may be determined based on the overall spray gun functionality desired.

A basic embodiment then for the configurable spray gun concept presented herein is the use of a selectable powder tube, a selectable spray nozzle and an adapter member that facilitates a configuration change when needed. The configuration change between a dilute phase powder tube and a dense phase powder tube allows the dense phase powder tube to be slid through the larger diameter dilute phase powder tube, thus allowing for minimal change in the rearward section 28, which is the common section of the two selectable spray gun configurations.

This also emphasizes that a spray gun that is connectable to a dense phase supply into a spray gun that is otherwise configured to spray powder from a dilute phase supply, is embodied in a basic form by providing a powder tube of a smaller diameter being inserted through a powder tube of a larger diameter up to the spray nozzle.

Figure 8:
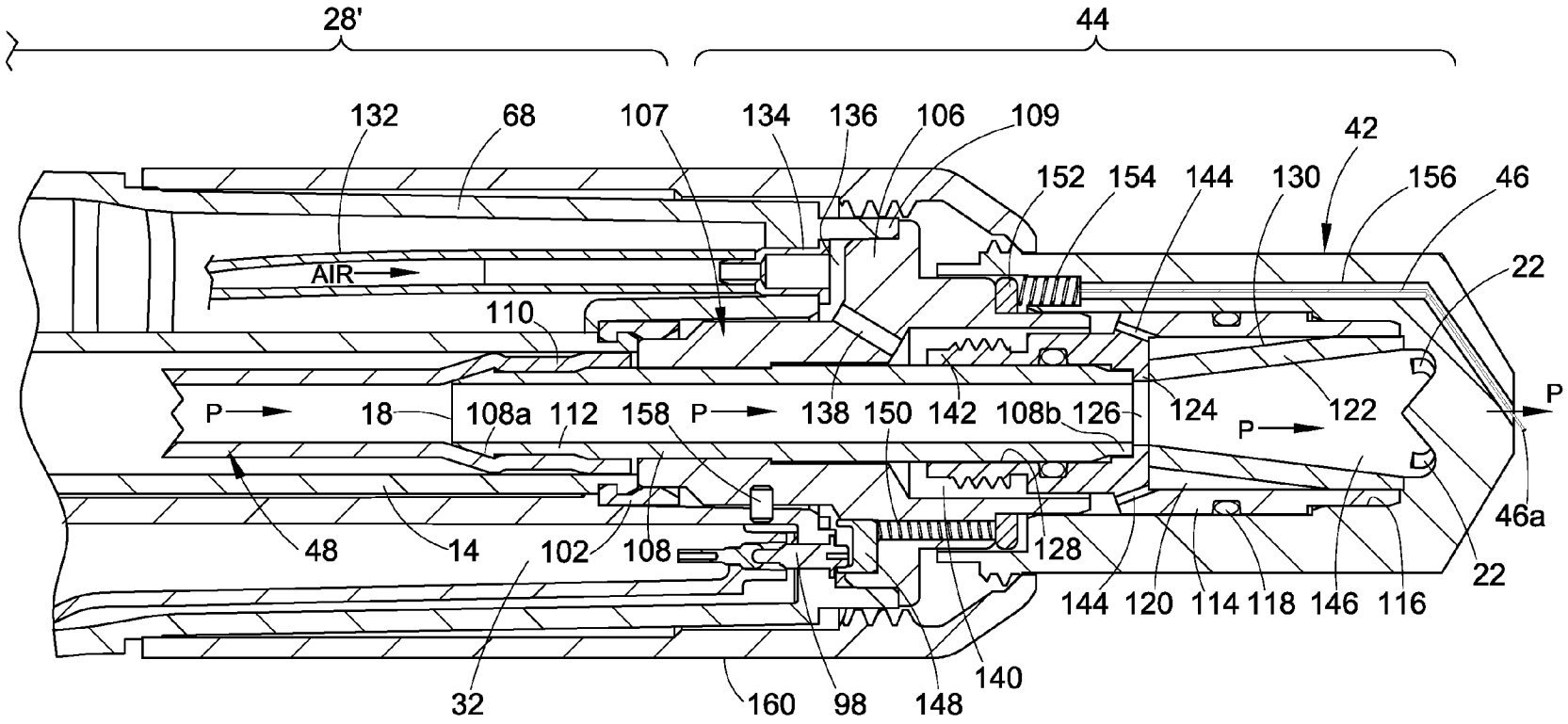
FIG. 8 is an enlarged view of the circled portion of FIG. 7.

With reference next to FIGS. 6-8, the second selectable spray gun configuration as realized in an exemplary embodiment of the second spray gun 40, includes the rearward section 28' and the second selectable forward section 44. Since the second spray gun 40 may optionally share the same rearward section 28' design as the first spray gun 10, with the exception of the second selectable powder tube 48, the description of that portion of the second spray gun 40 need not be repeated. But as shown in FIG. 6, the second spray gun 40 uses a supply hose 52 that connects to the dense phase pump 50. Therefore, the second spray gun 40 may use a different hose connector 104 to connect the second powder tube 48 to the powder supply hose 52. But this is an external connection and easily made without changing the rearward section 28' design. From FIG. 7 it is apparent how the second powder tube 48 can telescope through the first powder tube 14.

Figure 8A:
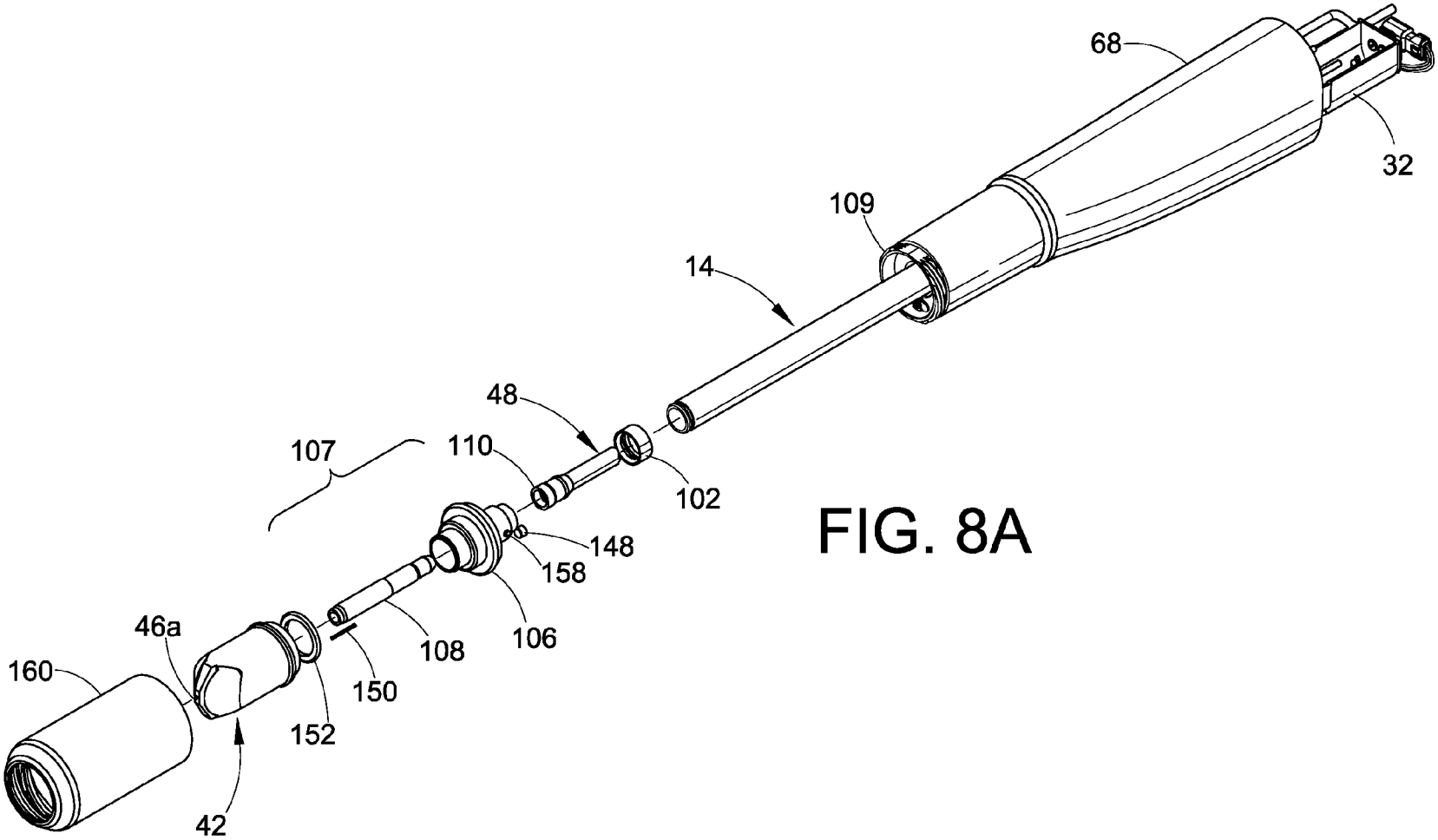
FIG. 8A is an exploded perspective of the selectable forward section of the second spray gun of FIG. 6.

The second forward section 44 is best illustrated in FIGS. 8 and 8A. In contrast to the first forward section 26 of the first spray gun 10, the spider 70 is replaced with an adapter tube holder 106. Because the powder being fed to the second spray nozzle 42 is dense phase, it is preferred to add air to the powder flow as the powder passes through the forward section 44. Air may be added using a member in the second spray nozzle 42 as will be further described below. Additionally, the dense phase powder is preferably diffused with added air before the powder flow is exposed to the electrode tip 46*a*. Accordingly, the electrode tip 46*a* may be disposed outside the second spray nozzle 42. Therefore, there is no need for a spider as is used with the first spray gun 10, but a structure may be provided to accommodate adding air to the powder flow.

The adapter tube holder 106 may be shaped similar to the spider 70 and is held in place between the second spray nozzle 42 and the front end portion 109 of the front gun body 68. The retaining seal 102 may join the back end of the adapter tube holder 106 with the first powder tube 14 in a manner similar to the spider 70 in the first spray gun 10. Note that the front gun body 68 may be the same as is used for the first spray gun 10 as part of the rearward section 28, 28' that is common to both selectable spray gun configurations. An adapter tube 108 is supported inside the adapter tube holder 106. The second powder tube 48 includes a forward portion 110 with an open end. A back end 108*a* of the adapter tube 108 may be snugly seated in the forward portion 110 of the second powder tube 48. For example, the second powder tube 48 may comprise an elastic material that allows a barbed end 112 to be inserted into the open end of the forward portion 110 of the second powder tube 48. The elastic material may assist the second powder tube 48 to conform to the shape of the barbed end 112. The adapter tube 108 and the adapter tube holder 106 comprise a selectable adapter assembly 107 that interfaces the second powder tube 48 and the second spray nozzle 42.

A diffuser support 114 is disposed in the second spray nozzle 42. The diffuser support 114 seats in a passage 116 in the second spray nozzle 42. A seal 118, such as an o-ring seal, is provided to form a seal interface between the passage 116 wall and the diffuser support 114. The forward end of the diffuser support 114 provides a first recess or cavity 120. An optional member 122, also referred to herein as a diffuser (also see the discussion regarding a diffuser 54 with respect to FIG. 2), for adding flow air to the powder flow P is disposed in the cavity 120 of the diffuser support 114. The diffuser support 114 includes a wall 124 with a passage 126 therethrough. The member 122 has a back end that abuts a forward surface of the wall 124. The diffuser support 114 includes a second cavity 128 that is axially separated from the first cavity 120 by the wall 124 but with the passage 126 therebetween. The forward end of the adapter tube 108 is disposed in the second cavity 128 and abuts a rearward surface of the wall 124. In this manner, powder can flow from the second powder tube 48 outlet end 18, through the adapter tube 108, through the air diffused cavity (146) provided by the member 122 and out the spray orifice 22.

The member or diffuser 122 may be provided as a hollow frusto-conical wall 130 that is made of an air permeable material, such as sintered polyethylene for example. An air tube 132 extends from a back end of the second spray gun 40 and is connectable to a supply of pressurized air (which for the ENCORE® model spray gun is used for electrode wash air). The forward end of the air tube 132 is attached to an air fitting 134. The air fitting 134 opens to a cavity 136 that is provided between the front end of the front gun body 68 and the adapter tube holder 106. In the first spray gun 10, the pressurized air through the air tube 132 may be used as electrode wash air as is known. The adapter tube holder 106 includes one or more air passages 138 that open to an adapter tube holder socket 140 that receives the back end 142 of the diffuser support 114. The diffuser support 114 also includes one or more air passages 144 that open to the first cavity 120 of the diffuser support 114. By this arrangement, pressurized air that is applied to the air tube 132 passes through the air fitting 134 into the air cavity 136, through the air passages 138 into the socket 140, and from the socket 140 through the air passages 144 and into the first cavity 120 of the diffuser support 114. The pressurized air flows through the air pervious material of the diffuser 122 and into the interior volume 146 of the diffuser 122 to mix with the powder flow for dilution or atomizing air. Note that the electrode coiled end 154 sits in a passage 156 which is in fluid communication with the socket 140, so that pressurized air from the air tube 132 still may be used to provide electrode wash air. Therefore, the pressurized air from the air tube 132 may serve both as electrode wash air and also as the atomizing or dilution air for the dense phase powder flow that enters the second spray nozzle 42.

The second spray nozzle 42 will typically be somewhat longer than the first spray nozzle 20 because of the diffuser 122. Because the spider 70 is not used in the second spray gun 40, a modified electrical connection between the multiplier 32 and the electrode 46 is provided. The multiplier output contact pin 98 makes contact with a conductive disk 148. An extension spring 150 is provided in contact with the conductive disk 148 at one end and a conductive ring 152 at the other. The conductive ring 152 also makes electrical contact with a coiled spring end 154 of the electrode 46. The electrode 46 extends through a passage 156 to the front of the second spray nozzle 42 so that the electrode tip 46*a* is disposed outside of the second spray nozzle 42.

An adapter key 158 arrangement, for example, a pin and slot configuration, may be used to key the adapter tube holder 106 to the front gun body 68. This key arrangement 158 can be used to assure that the conductive disk 148 is aligned with the extension spring 150 during assembly. Also, the key arrangement 158 may be used prevent a torsion or twist from being applied to the second powder tube 48 when the second spray nozzle 42 is assembled onto the second spray gun 40. This twist could occur if the adapter tube holder 106 is not keyed to the front gun body 68 because of the connection between the adapter tube 108 and the second powder tube 48.

A comparison of FIGS. 5 and 8 illustrates how the selectable spray gun configurations can be used or changed as the case may be. In order to change over the first spray gun 10 to the second spray gun 40 configuration, or alternatively to configure the second spray gun 40 based on the first spray gun 10, it will be noted that the assembler may remove the first spray nozzle 20 and the spider 70, and remove any hose connection at the back end of the first powder tube 14. Then the assembler can insert the second selectable powder tube 48 up through the first selectable powder tube 14 and snugly seat the open end 110 of the powder tube 48 onto the barbed end 112 of the adapter tube 108. The adapter tube 108 and the adapter tube holder 106 comprise the adapter assembly 107 that provides an interface or connection between the second powder tube 48 and the second spray nozzle 42. The adapter assembly 107 is installed onto the front gun housing 68 with the optional key 158 aligned properly. The adapter tube holder 106 and the adapter tube 108 therefore cannot rotate during further assembly of the second spray nozzle 42. The second spray nozzle 42 may be preassembled with the diffuser holder 114 already installed. After the adapter assembly 107 is installed, the second spray nozzle 42 can be installed by inserting the front end 108*b* of the adapter tube 108 into the second cavity 128 of the diffuser holder 114, and then the second nozzle nut 160 can be tightened onto the front gun body 68. Note that the second nozzle nut 160 need not be the same as the first nozzle nut 72 for the first spray gun 10.

It should be noted that the differences between the first selectable spray gun configuration 10 and the second spray gun configuration 40 all relate to easily accessible components on the outside front end of the spray gun, with the exception of inserting the second selectable powder tube 48 up through the first selectable powder tube 14 when the second spray gun configuration is to be used. The selectable forward sections are readily configured by removing the spray nozzle and the associated spider or adapter assembly and installing the alternative selectable parts for the desired configuration.

Another benefit of the selectively configurable spray gun concept is that for the second spray gun 40, it will be noted that the second selectable flow path includes the second powder tube 48 and the adapter tube 108 which is part of the adapter assembly 107. This allows the adapter tube material to be selected based on the type of powder coating material being sprayed, be it organic powder or porcelain enamel powder. The powder flow does not impact surfaces as would occur when a spider is used, so the adapter support housing 106 will not exhibit wear.

Figures 10, 11:
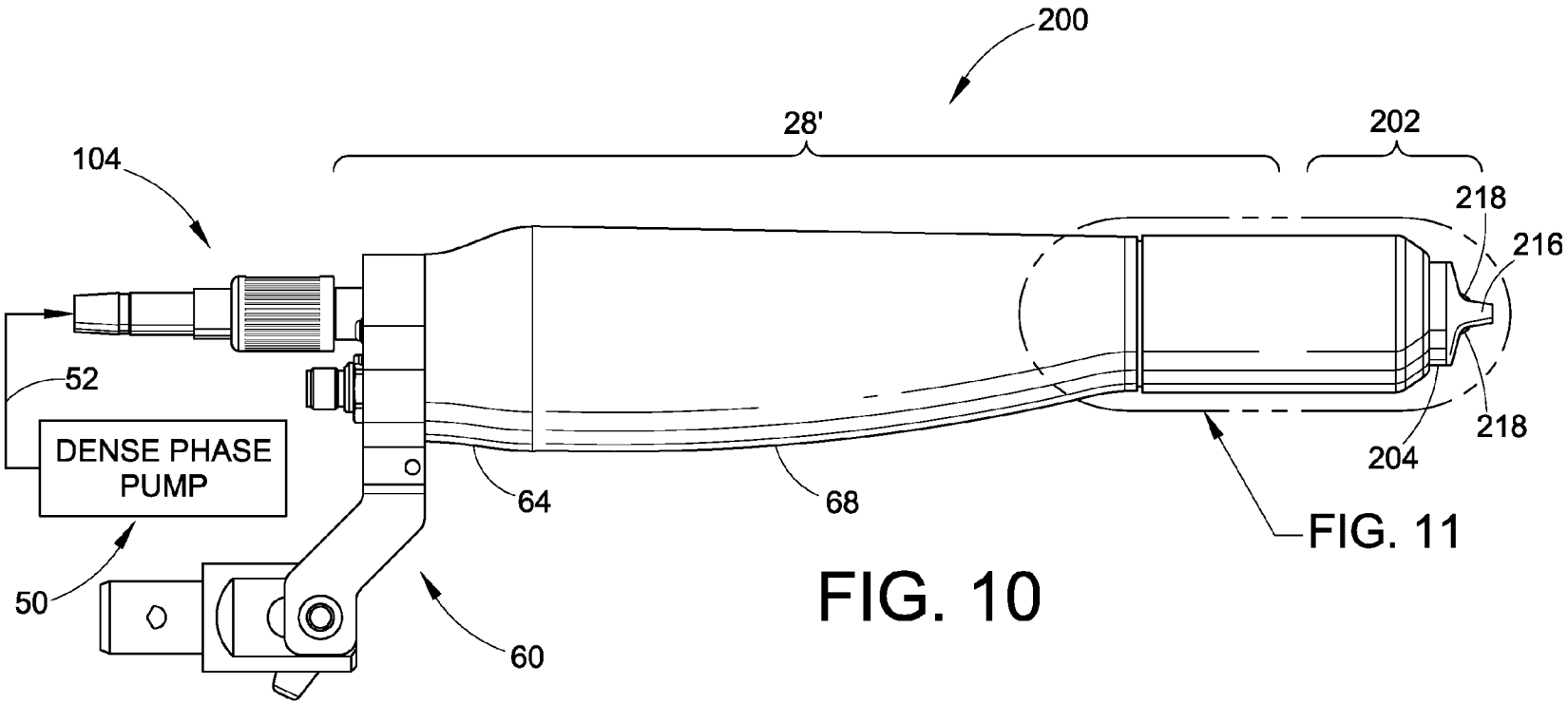
FIG. 10 is another embodiment in elevation of a selectable spray gun configuration for a dense phase delivery and using an air cap.
FIG. 11 is a longitudinal cross-section of a forward section of the spray gun of FIG. 10 noted by the circled region of FIG. 10.
Figure 11:
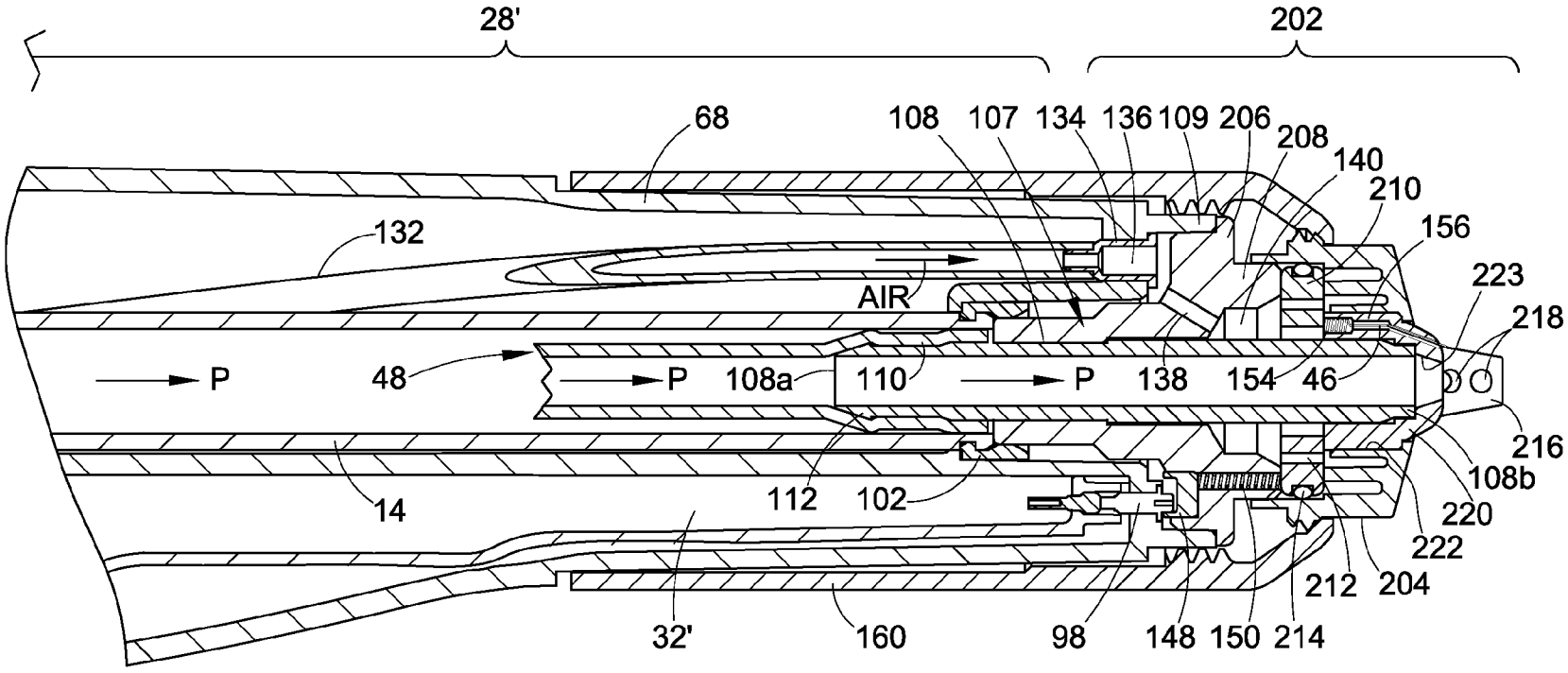
Figure 12:
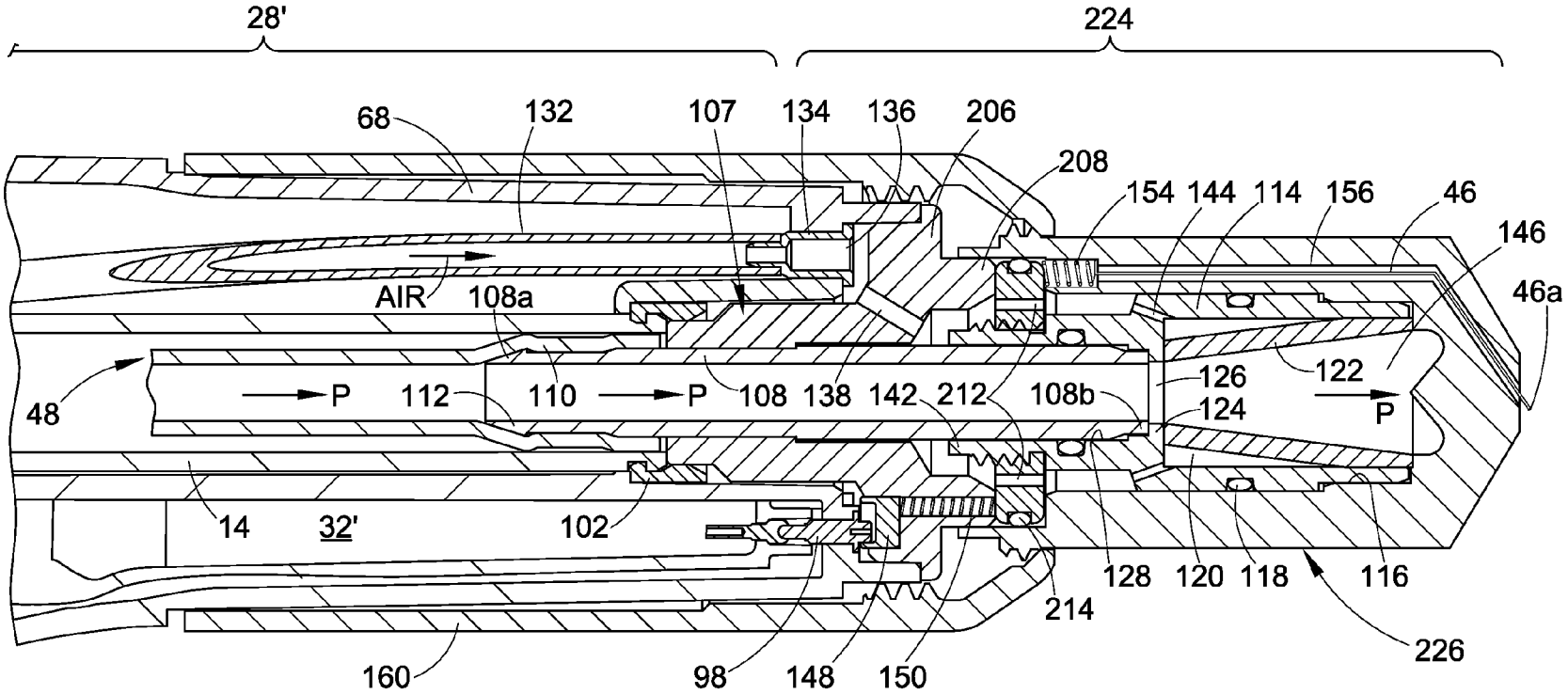
FIG. 12 is another embodiment of a selectable forward section for a dense phase delivery and using a spray nozzle.

With reference to FIGS. 10-12 we illustrate additional embodiments of the spray gun 40 in FIG. 2 which is an embodiment of the second selectable configuration. The second selectable spray gun configuration is a spray gun that may be connected to a dense phase powder supply but produces a spray pattern using a dilute phase spray nozzle, and an optional electrode. Such a spray gun 200, therefore, shares most of the features described hereinabove for the embodiments of FIGS. 6-8A, but the second selectable forward section 44 has been modified so that the spray gun 200 may be not only selectively configured as a dilute phase delivery spray gun or a dense phase delivery spray gun, but additionally for the dense phase delivery spray gun configuration may further be optionally configured with a slot style spray nozzle (FIG. 12) or an air cap (FIGS. 10 and 11). A difference between a slot style spray nozzle and an air cap is that the air cap may be used to add dilution air to the powder flow that exits the powder tube 48 (FIG. 2). With the slot style spray nozzle, dilution air is added using a diffuser 54 or other structure within the spray nozzle, as was described herein with reference to FIGS. 2 and 8. Thus, the second selectable forward sections of FIGS. 8, 11 and 12 are installed in place of the first selectable forward section 26 of the spray gun of FIGS. 1 and 5 (which may be but need not be an ENCORE® model) in order to configure the spray gun for dense phase delivery.

In order to provide a second selectable forward section that accommodates either an air cap or a slot style spray nozzle, we illustrate additional embodiments and modifications to the second selectable forward section 44 as compared with the embodiments of FIGS. 3-8A. But the rest of the features and options already presented herein may be used and so need not be repeated, and like reference numerals are used for like components for clarity. For example, FIGS. 10-12 show a bar mount configuration but a tube mount configuration may alternatively be used. The spray gun 200 may also use electrostatic or non-electrostatic coating processes.

The air cap style configurable spray gun 200 of FIGS. 10 and 11 may include a second selectable forward section 202, as well as the same rearward section 28' as used with the spray gun 10. The second selectable forward section 202 differs from the second selectable forward section 44 of FIGS. 6-8A in that it facilitates use of a selectable third configuration, for example, a PRODIGY® model air cap 204 available from Nordson Corporation. The PRODIGY® model spray gun is fully disclosed in U.S. Pat. No. 7,793,869 to Mater, et al for PARTICULATE MATERIAL APPLICATOR AND PUMP, the entire disclosure of which is fully incorporated herein by reference.

In order to further realize the benefit of being able to provide multiple selectable spray gun configurations that share many common components, the second selectable forward section 202 has the benefit that the spray gun 200 may have either an air cap configuration or a slot style spray nozzle configuration by simply selecting which front end to use. Moreover, with the modified second selectable forward section 202, the forward section can now accept or support spray nozzles and air caps that were previously designed and are in use with the PRODIGY® model spray guns available from Nordson Corporation, Westlake, Ohio. This further enhances the savings of not needing special parts and inventory for different spray gun configurations because now a spray gun, for example an ENCORE® model spray gun, that is capable of spraying dilute phase powder from a dilute phase powder supply like a Venturi pump, can be selectively configured to spray dense phase powder from a dense phase powder supply and spray the powder through a spray nozzle or air cap that is otherwise usable with dense phase spray guns, for example a PRODIGY® model spray gun.

With reference then to FIG. 11, it should be noted that many of the components in the second selectable forward section 202 may be the same as the embodiment of FIG. 8 herein and therefore like reference numerals are used and the description need not be repeated. Only the different components will be described as needed. The second selectable forward section 202 includes a modified adapter tube holder 206 as compared to the adapter tube holder 106 of FIG. 8. The main difference is that the modified adapter tube holder 206 has a truncated front end 208 rather than the front cylinder portion of the adapter tube holder 106. The modified adapter tube holder 206 front end engages the back end of a conductive ring 210.

The conductive ring 210 includes one or more air passages 212 so that pressurized air that is supplied from the air tube 132 passes through the air passages 138 in the adapter tube holder 206, through a space 140 between the air passages 138 and the conductive ring 210, and then through the conductive ring air passages 212 and out the air cap 204. The air cap 214 includes horns 216 with air passages 218 that are in fluid communication with the air passages 212 in the conductive ring 210. This allows the atomizing air to diffuse the dense phase powder as the powder flow exits the outlet end 108*b* of the adapter tube 108. A seal 214 such as an o-ring for example may be used to force the pressurized air that passes through the adapter holder 206 into the air cap 204. In this way, the pressurized air from the air tube 132 may be used as both electrode wash air and as the dilution or atomizing air for the dense phase powder that exits the adapter tube 108 into the air cap 204.

With this modified adapter tube holder 206 then, a conventional PRODIGY® model air cap may be used with the second selectable forward section 202. Of course, other air caps may be used as needed for particular applications. Note that when the air cap 204 is used, there is no need for the air diffuser support 114. In order to couple electrical energy to the electrode 46, we provide a hollow insert 220 in a cavity 222 of the air cap 204. This insert 220 receives the powder flow that exits the adapter tube end 198*b*, and may further optionally be used to support the electrode 46 for electrostatic coating operations. The electrode 46 is received in a passage 156 and has a coiled spring end 154 that makes contact with the conductive ring 210. In addition, the insert 220 may be provided with an inwardly tapered, for example frusto-conical, forward opening 223 that helps to shape the powder flow pattern and keep the powder directed toward the centerline P of the powder flow path as the powder exits the air cap 204. This directed flow can improve the ability to electrostatically charge the powder.

With reference to FIG. 12, the modified adapter tube holder 206 may also be used with a slot style spray nozzle to provide yet another (third) selectable spray gun configuration that can receive dense phase powder flow and spray the powder through a dilute phase nozzle. As noted above, the modified adapter tube holder 206 allows a spray gun, which in one configuration may be a dilute phase spray gun, for example a spray gun like the ENCORE® model spray gun, to be configured for a dense phase powder supply but with a front end that sprays the powder in dilute phase, for example spray nozzles and air caps used with a PRODIGY® model spray gun.

The selectable second forward section 224 for the third configurable spray gun may include the same adapter tube holder 206, conductive ring 210, air passages 212, and seal 214 as the embodiment of FIGS. 10 and 11. The diffuser support 114 and the diffuser 122 may be the same as in the FIG. 8 embodiment. The primary difference then between the embodiment of FIG. 8 and the embodiment of FIG. 12 is that the modified adapter tube holder 206 allows use of a conventional PRODIGY® model spray gun spray nozzle 226 and diffuser 122 to be used rather than the spray nozzle 42. Of course, other spray nozzles may alternatively be used as needed for particular applications.

Therefore, the modified adapter tube holder 206 in FIGS. 11 and 12 facilitates two additional selectable spray gun configurations using an air cap or spray nozzle that may also be useable with a PRODIGY® model spray gun.

Figure 13:
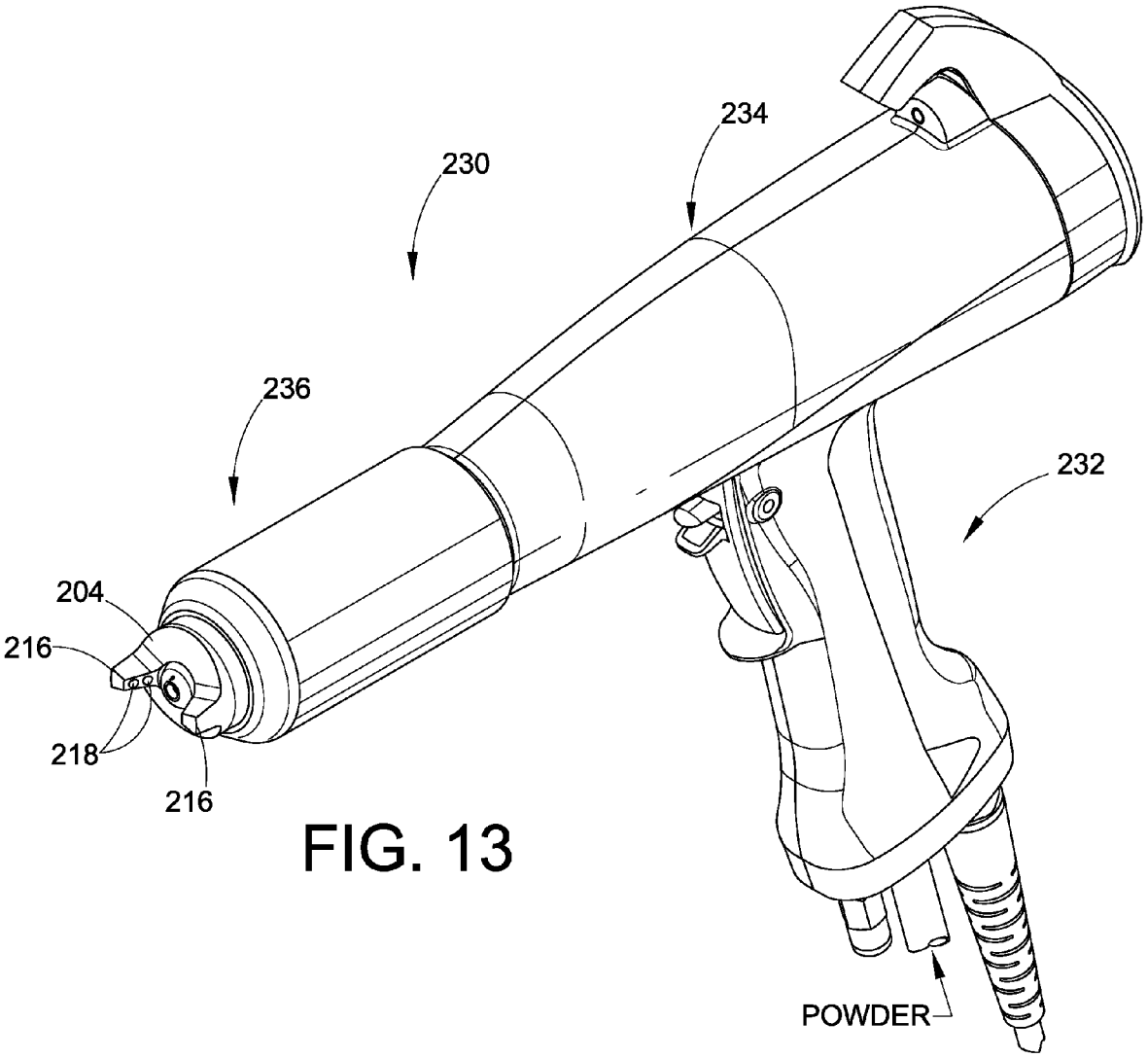
FIG. 13 is an isometric view of a manual spray gun for dense phase delivery and using an air cap.
Figure 14:
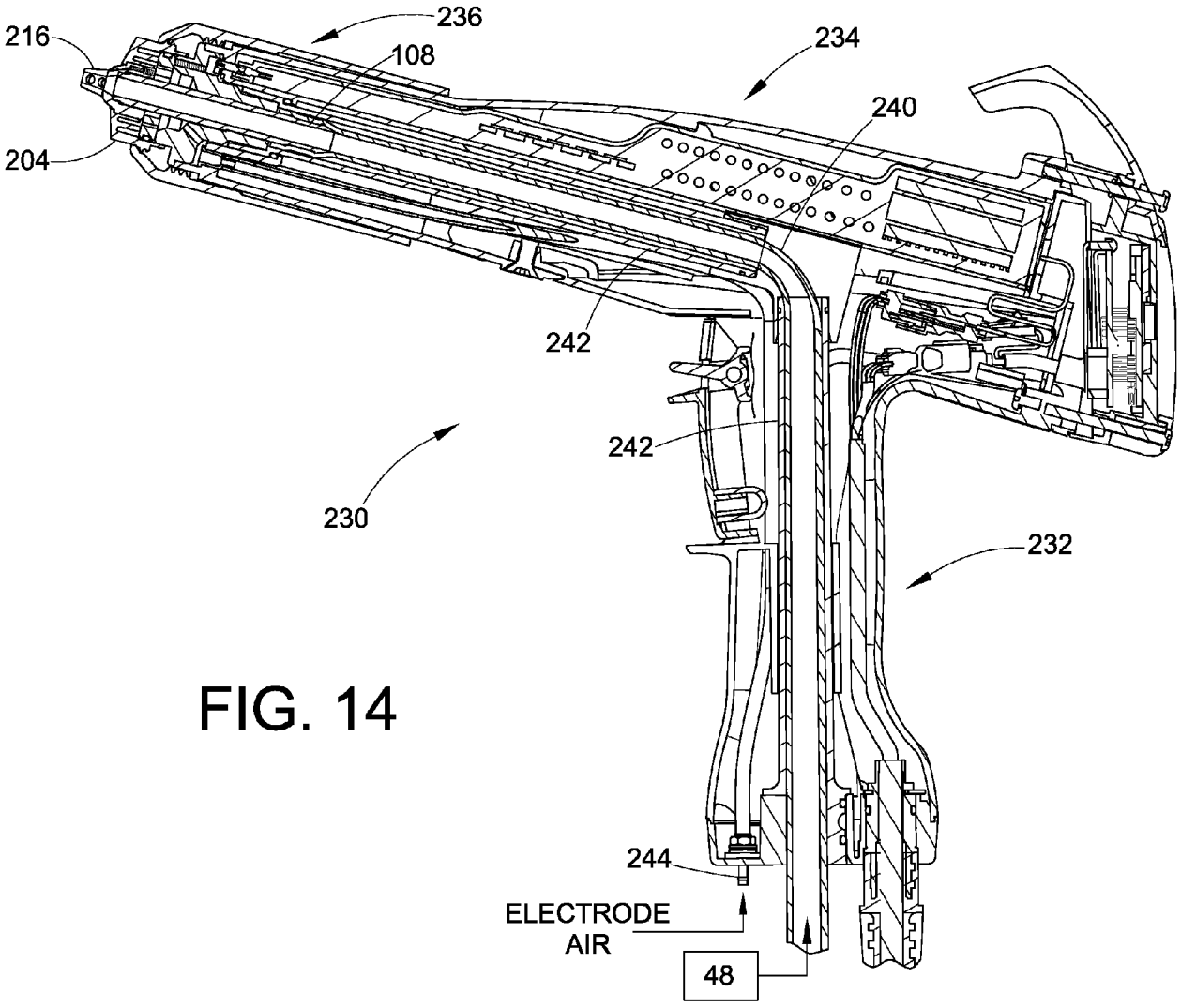
FIG. 14 is a longitudinal cross-section of the manual spray gun of FIG. 13.

With reference to FIGS. 13 and 14, we illustrate an exemplary embodiment of a manual spray gun that may also have three selectable configurations. The manual spray gun 230 for the most part may be, for example, an ENCORE® model manual spray gun, which is designed for use with dilute phase powder from, for example, a Venturi pump. However, alternatively, other manual spray guns with dilute phase delivery may be used. The ENCORE® model manual spray gun is well known and commercially available from Nordson Corporation, Westlake, Ohio and therefore need not be described in detail. This manual spray gun is also fully disclosed in United States Published Patent Application number 2009/0107397 A1 for APPARATUS AND METHODS FOR PURGING MATERIAL APPLICATION DEVICE, the entire disclosure of which is fully incorporated herein by reference. A manual ENCORE® model spray gun therefore is an embodiment of one of the three selectable manual spray gun configurations.

The manual spray gun 230 illustrated in FIGS. 13 and 14 includes a manually gripped handle 232, a barrel 234 and a forward section or nozzle assembly 236 at the front end. For a manual ENCORE® model spray gun using a dilute phase powder supply, the nozzle assembly 236 may be the same as the first selectable forward section 26 described herein with respect to FIG. 5. However, by configuring the nozzle assembly 236 to have the same selectable forward section 44 in FIG. 8 or alternatively the same selectable forward section 202 as illustrated in FIG. 11 or alternatively the same selectable forward section 226 in FIG. 12 (each of which may be used in place of the forward section 26 of FIG. 5 for an automatic or manual spray gun), the spray gun 230 may be used with dense phase delivery; and conveniently may be used with a conventional PRODIGY® model spray gun air cap 204, as is shown with the FIG. 11 embodiment or a PRODIGY® model spray gun spray nozzle 226 as is shown in FIG. 12. In addition, a smaller diameter powder hose 240 which is connectable to a dense phase pump 48, can be inserted through the larger dilute phase powder path 242 that is already present in an ENCORE® model spray gun. The smaller diameter powder hose 240 can be inserted through the handle 232 and the barrel 234 to be attached to the back end of the adapter tube 108. Thus, the spray gun 230 of FIG. 14 is a manual spray gun otherwise designed for dilute phase powder delivery, that may optionally be configured to receive dense phase powder delivery and to spray that powder through a PRODIGY® model spray gun air cap 238, or other air cap as needed.

The nozzle assembly 236 may use the same adapter tube holder 206 and related components as the embodiments of FIGS. 11 and 12, which allows the manual spray gun 230 to be used with an air cap 204 (FIG. 11) or alternatively a slot type spray nozzle 226 (FIG. 12), for example the PRODIGY® model spray gun air cap or spray nozzle, as the second and third selectable configurations, in a manner similar to the automatic spray gun configurations of FIGS. 11 and 12. Moreover, the manual spray gun 230 may have a fourth selectable configuration in that the second selectable forward section 44 of FIG. 8 may be used for the nozzle assembly 236.

It will be also noted that in a manner similar to the automatic spray gun embodiments herein (FIGS. 8, 11 and 12), the atomizing air for the nozzle assembly 236 may be provided through the air inlet 244 that is used for electrode air wash for the ENCORE® model spray gun. Therefore, the embodiments of FIGS. 11, 12 and 14 may use the modified adapter tube holder 206, which includes air passages 132, in a like manner with the adapter tube holder 106 in FIG. 8. Therefore, all these embodiments (FIGS. 8, 11, 12 and 14) may use the pressurized air via the air tube 132 for both electrode wash air and for atomizing/dilution air.

Figure 9:
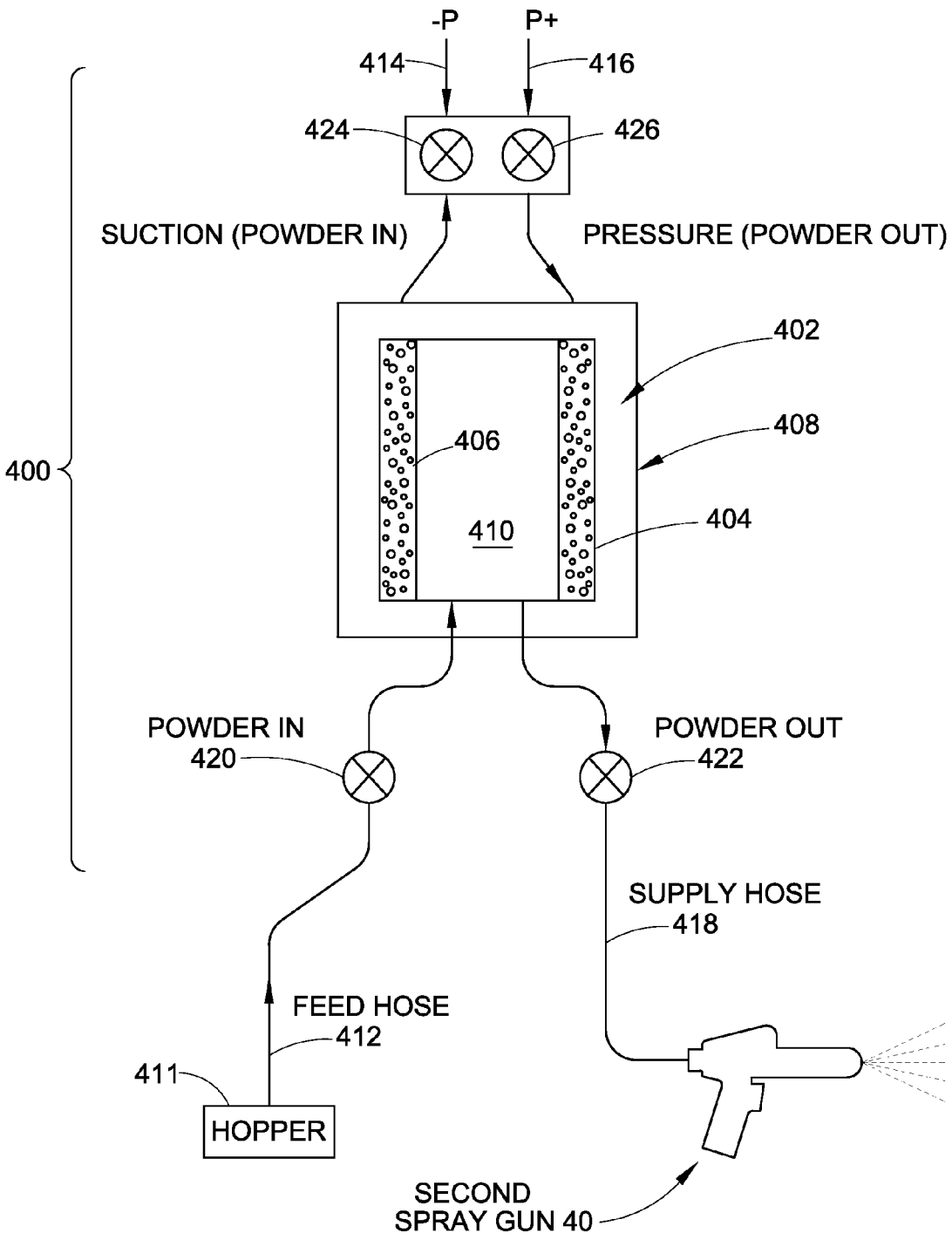
FIG. 9 is a schematic drawing of an exemplary dense phase pump that may be used with the present inventions.

We have referred to a dense phase powder pump 50 in the above disclosure, which is also commonly known as high density powder pumps. There are many different dense phase pumps available commercially, and one such pump is described in U.S. Pat. No. 7,997,878 issued on Aug. 16, 2011, to Terrence M. Fulkerson for DENSE PHASE POWDER PUMP WITH SINGLE ENDED FLOW AND PURGE; and U.S. Pat. No. 7,150,585 issued on Dec. 19, 2006, to Kleineidam et al. for PROCESS AND EQUIPMENT FOR THE CONVEYANCE OF POWDERED MATERIAL, the entire disclosures of which are fully incorporated herein by reference. With reference to FIG. 9, an exemplary dense phase pump 400 may use at least one or more pump chambers 402 in the form of a hollow cylinder 404 made of an air porous material 406. The material 406 for the pump chamber 402 may be but need not be similar to the air diffuser 58 described herein, for example sintered polyethylene. Each pump chamber 402 is disposed in a pressure chamber 408 such that powder is drawn into a pump chamber volume 410 from a powder supply 411 through a feed hose 412 when the pressure chamber 408 has negative pressure applied from a vacuum source 414, and powder is pushed out of the pump chamber 408 to a supply hose 418 when positive pressure is applied from a pressure source 416 to the pressure chamber volume 410. Control of powder into and out of the pump chambers may be accomplished with powder flow control valves, for example, pneumatic pinch valves 420 (powder in) and 422 (powder out) respectively, which open and close out of phase with respect to each other as is known. Pressure control valves, for example vacuum control valve 424 and positive pressure control valve 426 may also be used to control the timing of when negative and positive pressure cycles occur. The low flow air for dense phase powder flow arises from the use of pressure to move the powder, as opposed to high velocity air as used in a dilute phase powder pump such as a Venturi pump. Different dense phase powder pump designs may produce powder flows that vary in the powder/air ratio or in other words how rich the powder flow is into the spray gun, and similarly different Venturi pump designs may produce different levels of lean powder flows. For this reason we do not limit the disclosure herein to a definition of what is dense phase versus dilute phase. But a dense phase powder flow will typically be used with smaller diameter or cross-sectional powder flow paths as compared to a dilute phase powder flow path due to the lower flow air volume in the powder flow. The schematic of FIG. 9 shows an embodiment of the inventive concept of the second selectable spray gun configuration 40 that uses a dense phase powder flow into the second spray gun 40 and sprays the powder from a dilute phase selectable forward section 44.

The inventions have been described with reference to the exemplary embodiments. Modifications and alterations will occur to others upon a reading and understanding of this specification and drawings. It is intended to include all such modifications and alterations insofar as they come within the scope of the appended claims or the equivalents thereof.

We claim:

1. A spray gun configured to selectively operate with a Venturi pump or a dense phase powder pump, the spray gun comprising:

a gun body comprising a selectable forward section and a rearward section, said selectable forward section comprising a selectable spray nozzle, said gun body including a selectable powder flow path comprising an inlet end and an outlet end, wherein powder coating material flows from said inlet end to said outlet end and from said outlet end to said selectable spray nozzle, said selectable powder flow path having a constant cross-sectional area from said powder flow path inlet end to said powder flow path outlet end, said rearward section configured to join to said selectable forward section selected from either of a first selectable forward section or a second selectable forward section to form either of a first selectable spray gun configuration or a second selectable spray gun configuration respectively, said first selectable spray gun configuration comprising a first selectable spray nozzle and a first selectable powder flow path, said first selectable powder flow path comprises a first cross-sectional area and is at least partially defined by a first selectable powder tube that is configured to receive the powder coating material from a dense phase pump when the spray gun is configured in said first selectable spray gun configuration, said second selectable spray gun configuration comprising a second selectable spray nozzle and a second selectable powder flow path, said second selectable powder flow path comprises a second cross-sectional area and is at least partially defined by a second selectable powder tube that is configured to receive the powder coating material from a dilute phase pump when the spray gun is configured in said second selectable spray gun configuration, and said first cross-sectional area being smaller than said second cross-sectional area.

2. A spray gun configured to selectively operate with a Venturi pump or a dense phase powder pump, the spray gun comprising:

a gun body comprising a selectable forward section and a rearward section, said selectable forward section comprising a selectable spray nozzle, said gun body including a selectable powder flow path comprising an inlet end and an outlet end, wherein powder coating material flows from said inlet end to said outlet end and from said outlet end to said selectable spray nozzle, said selectable powder flow path having a constant cross-sectional area from said powder flow path inlet end to said powder flow path outlet end, said rearward section configured to join to said selectable forward section selected from either of a first selectable forward section or a second selectable forward section to form either of a first selectable spray gun configuration or a second selectable spray gun configuration respectively, said first selectable spray gun configuration comprising a first selectable spray nozzle and a first selectable powder flow path, said first selectable powder flow path comprises a first cross-sectional area, said second selectable spray gun configuration comprising a second selectable spray nozzle and a second selectable powder flow path, said second selectable powder flow path comprises a second cross-sectional area, said first cross-sectional area being different from said second cross-sectional area, said first selectable spray nozzle comprising a member for adding air to the powder coating material flowing into said first selectable spray nozzle, said member having an expansion chamber, wherein air flows through a wall of said expansion chamber to mix with the powder coating material that enters said expansion chamber from said first selectable powder flow path, and said expansion chamber comprising a frusto-conical air diffuser, said air diffuser having an inlet end having a cross-sectional area that is the same as said first cross-sectional area.

3. The spray gun of claim 1, wherein said first selectable powder tube extends through said second selectable powder tube when the spray gun is configured in said first selectable spray gun configuration.

4. The spray gun of claim 1, wherein said first selectable spray nozzle supports an electrode having an electrode tip positioned outside said first selectable spray nozzle.

5. The spray gun of claim 1, wherein said second selectable spray nozzle supports an electrode having an electrode tip positioned inside said second selectable spray nozzle.

6. The spray gun of claim 1, wherein said gun body further comprises a handle that is manually held during a coating operation.

7. The spray gun of claim 1, in combination with a dense phase pump comprising a pump chamber disposed in a pressure chamber, first and second valves configured to control suction and pressure to said pressure chamber to draw powder coating material into said pump chamber and push powder coating material out of said pump chamber, and third and fourth valves configured to control inlet and outlet of powder coating material to the pump chamber, said dense phase pump supplying powder coating material to said spray gun through a first selectable powder hose having said first cross-sectional area when the spray gun is configured for said first selectable spray gun configuration.

8. The spray gun of claim 1, wherein said second selectable powder flow path is at least partially defined by a powder tube that is adapted to receive powder from a Venturi pump.

9. A spray gun configured to selectively operate with a Venturi pump or a dense phase powder pump, the spray gun comprising:

a gun body comprising a forward section and a rearward section, said forward section comprising a selectable spray nozzle, said rearward section including a powder flow path that is connectable at an inlet end to a powder coating material pump and at an outlet end to said selectable spray nozzle, the powder flow path having a constant cross-sectional area from said powder flow path inlet end to said powder flow path outlet end, said rearward section configured to join either of a first selectable spray nozzle or a second selectable spray nozzle to form either of a first selectable spray gun configuration or a second selectable spray gun configuration respectively, said first selectable spray gun configuration comprising the first selectable spray nozzle and a first selectable powder flow path, said first selectable powder flow path having a first cross-sectional area and is at least partially defined by a first selectable powder tube that is configured to receive a powder coating material from a dense phase pump when the spray gun is configured in said first selectable spray gun configuration, and an adapter assembly to connect said rearward section and said first selectable spray nozzle, said second selectable spray gun configuration comprising the second selectable spray nozzle and a second selectable powder flow path, said second selectable powder flow path having a second cross-sectional area and is at least partially defined by a second selectable powder tube that is configured to receive the powder coating material from a dilute phase pump when the spray gun is configured in said second selectable spray gun configuration, and said first cross-sectional area being smaller than said second cross-sectional area.

10. The spray gun of claim 9, wherein when the spray gun is in said first selectable spray gun configuration, said first selectable spray nozzle comprises a diffuser for adding air to powder coating material when the powder coating material is flowing through said first selectable spray nozzle.

11. A spray gun configured to selectively operate with a Venturi pump or a dense phase powder pump, the spray gun comprising:

a gun body comprising a selectable forward section and a rearward section, a selectable spray nozzle, and a selectable powder flow path, the rearward section configured to join to said selectable forward section selected from either of a first selectable forward section or a second selectable forward section to form either of a first selectable spray gun configuration or a second selectable spray gun configuration respectively, said first selectable spray gun configuration comprising a first selectable spray nozzle and a first selectable powder flow path, the first selectable powder flow path having a first cross-sectional area and is at least partially defined by a first selectable powder tube that is configured to receive a powder coating material from a dense phase pump when the spray gun is configured in said first selectable spray gun configuration, said second selectable spray gun configuration comprises a second selectable spray nozzle and a second selectable powder flow path, the second selectable powder flow path having a second cross-sectional area and is at least partially defined by a second selectable powder tube that is configured to receive the powder coating material from a dilute phase pump when the spray gun is configured in said second selectable spray gun configuration, and the first cross-sectional area being smaller than said second cross-sectional area.

12. A spray gun for use with a dense phase powder supply, the spray gun comprising:

a forward section that is configured to spray a dense phase powder flow, and a rearward section having a powder inlet that is connectable to a dense phase powder supply, and a first powder tube having a first cross-sectional area that extends through a second powder tube having a second cross-sectional area that is larger than the first cross-sectional area, wherein when said first powder tube is connectable to the dense phase powder supply, the dense phase powder flow passes through said first powder tube to a spray nozzle or an air cap, wherein when said first powder tube is removed from the spray gun, said second powder tube is connectable to a dilute phase powder supply and a different forward section is installed in place of said forward section, with said different forward section being configured to spray a diluted powder flow from the dilute phase powder supply.

13. The spray gun of claim 12, wherein the spray gun is a manual spray gun.

14. The spray gun of claim 12, wherein said forward section includes a diffuser for adding dilution air to the dense phase powder flow through said forward section.

* * * * *